US010623842B2

(12) United States Patent
Igarashi et al.

(10) Patent No.: US 10,623,842 B2
(45) Date of Patent: Apr. 14, 2020

(54) SOUND OUTPUT APPARATUS

(71) Applicant: SONY CORPORATION, Tokyo (JP)

(72) Inventors: Go Igarashi, Tokyo (JP); Yasuhide Hosoda, Kanagawa (JP); Miki Tokitake, Tokyo (JP); Ken Tanaka, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/077,357

(22) PCT Filed: Dec. 27, 2016

(86) PCT No.: PCT/JP2016/088918
§ 371 (c)(1),
(2) Date: Aug. 10, 2018

(87) PCT Pub. No.: WO2017/149915
PCT Pub. Date: Sep. 8, 2017

(65) Prior Publication Data

US 2019/0052950 A1 Feb. 14, 2019

(30) Foreign Application Priority Data

Mar. 1, 2016 (JP) ..... 2016-039004

(51) Int. Cl.
*H04R 1/10* (2006.01)
*H04R 1/28* (2006.01)

(52) U.S. Cl.
CPC ..... *H04R 1/1016* (2013.01); *H04R 1/10* (2013.01); *H04R 1/105* (2013.01); *H04R 1/1033* (2013.01);
(Continued)

(58) Field of Classification Search
CPC ..... H04R 1/105; H04R 2225/021; H04R 2225/63
(Continued)

(56) References Cited

U.S. PATENT DOCUMENTS 3,045,073 A * 7/1962 Vickerson ..... H04R 25/65 381/109
3,493,695 A * 2/1970 Stork ..... H03F 3/183 320/DIG. 15
(Continued)

FOREIGN PATENT DOCUMENTS

AU 4552499 A 2/2000
BR 112017008221 A2 1/2018
(Continued)

OTHER PUBLICATIONS

International Search Report and Written Opinion of PCT Application No. PCT/JP2016/088918, dated Apr. 4, 2017, 09 pages of ISRWO.
(Continued)

*Primary Examiner* — Suhan Ni
(74) *Attorney, Agent, or Firm* — Chip Law Group

(57) ABSTRACT

Provided is a sound output apparatus which realizes listening characteristics of the ambient sound even in a wearing state, which are equivalent to those in a non-wearing state, and outputs good acoustic information at the same time. A sound output apparatus 100 includes a sound generation unit 110 which generates sound, a sound guiding unit 120 which takes in, from one end 121, the sound generated from the sound generation unit 110, and a ring-shaped holding unit 130 which holds the sound guiding unit 120 in the vicinity of the other end 122. The sound output apparatus 100 is worn on the pinna by locking the holding unit 130 to the intertragic notch, and the holding unit 130 supports the vicinity of the other end 122 of the sound guiding unit 120
(Continued)

so that a sound output hole of the other end 122 of the sound guiding unit 120 is positioned to face the interior side of the ear canal.

16 Claims, 27 Drawing Sheets

(52) U.S. Cl.
CPC ..... *H04R 1/2857* (2013.01); *H04R 2460/09* (2013.01); *H04R 2460/11* (2013.01)

(58) Field of Classification Search
USPC ..... 381/330, 381–382
See application file for complete search history.

(56) References Cited

U.S. PATENT DOCUMENTS

| | | | | |
|---|---|---|---|---|
| 3,610,841 | A * | 10/1971 | Hutchings | H04M 1/05 379/430 |
| 4,864,610 | A | 9/1989 | Stevens | |
| 5,459,290 | A | 10/1995 | Yamagishi | |
| 6,307,943 | B1 | 10/2001 | Yamagishi | |
| 6,681,022 | B1 | 1/2004 | Puthuff et al. | |
| 8,249,287 | B2 * | 8/2012 | Silvestri | H04R 1/1016 381/380 |
| 2002/0096391 | A1 * | 7/2002 | Smith | H04R 1/10 181/135 |
| 2006/0215864 | A1 | 9/2006 | Espersen et al. | |
| 2011/0091056 | A1 | 4/2011 | Nishizaki et al. | |
| 2012/0321114 | A1 | 12/2012 | Ishibashi et al. | |
| 2017/0311070 | A1 | 10/2017 | Igarashi et al. | |
| 2018/0324513 | A1 | 11/2018 | Igarashi et al. | |

FOREIGN PATENT DOCUMENTS

| | | | |
|---|---|---|---|
| CA | 2964710 | A1 | 5/2016 |
| CN | 101023707 | A | 8/2007 |
| CN | 101690256 | A | 3/2010 |
| CN | 102595270 | A | 7/2012 |
| CN | 202310041 | U | 7/2012 |
| CN | 107113487 | A | 8/2017 |
| EP | 0421681 | A2 | 4/1991 |
| EP | 1787493 | A1 | 5/2007 |
| EP | 2328362 | A1 | 6/2011 |
| EP | 2579620 | A1 | 4/2013 |
| EP | 3214850 | A1 | 9/2017 |
| EP | 3429223 | A1 | 1/2019 |
| JP | 03-117999 | A | 5/1991 |
| JP | 3057731 | B2 | 7/2000 |
| JP | 2008-512882 | A | 4/2008 |
| JP | 4694656 | B2 | 6/2011 |
| JP | 4709017 | B2 | 6/2011 |
| JP | 6394827 | B2 | 9/2018 |
| JP | 2018-170810 | A | 11/2018 |
| KR | 100198003 | B1 | 6/1999 |
| KR | 10-2017-0080575 | A | 7/2017 |
| WO | 00/05924 | A1 | 2/2000 |
| WO | 2006/026988 | A1 | 3/2006 |
| WO | 2010/150475 | A1 | 12/2010 |
| WO | 2016/067700 | A1 | 5/2016 |

OTHER PUBLICATIONS

Extended European Search Report of EP Patent Application No. 16892749.9, dated Feb. 1, 2019, 09 pages.
Office Action for CN Patent Application No. 201680082598.0, dated Jul. 16, 2019, 08 pages of Office Action and 11 pages of English Translation.
Office Action for EP Patent Application No. 16892749.9, dated Feb. 10, 2020, 05 pages of Office Action.

* cited by examiner

SOUND OUTPUT APPARATUS

CROSS REFERENCE TO RELATED APPLICATIONS

This application is a U.S. National Phase of International Patent Application No. PCT/JP2016/088918 filed on Dec. 27, 2016, which claims priority benefit of Japanese Patent Application No. JP 2016-039004 filed in the Japan Patent Office on Mar. 1, 2016. Each of the above-referenced applications is hereby incorporated herein by reference in its entirety.

TECHNICAL FIELD

The technology disclosed herein relates to a sound output apparatus used by being worn on the ears of a listener.

BACKGROUND ART

Many of currently widespread earphones are shaped to be put into the ears of a listener. For example, the inner ear type earphones have a shape to be hooked on the pinnae of the listener. In addition, the canal type earphones have a shape to be used by being put deeply into the ear holes (ear canals) (e.g., see Patent Document 1), often have a structure of hermetically sealed type, and have a relatively good sound insulation performance. Thus, there is an advantage that music can be enjoyed even in places with somewhat loud noise.

On the other hand, even when the listener wears the earphones and listens to the presented sound, the listener also needs to listen to ambient sound at the same time, for example, when the people around the listener speak to him/her. It is a dangerous situation if the listener cannot listen to the ambient sound. However, most of the conventional earphones such as the canal type are structured to close the ear holes almost completely in the wearing state. Thus, it is extremely difficult for the listener to listen to the ambient sound during listening and watching. Moreover, to the people around, the conventional earphones appear to close the ear holes of the listener in the wearing state. This gives the impression that it is hard to talk to the wearer of the earphones and inhibits communication between people.

CITATION LIST

Patent Document

Patent Document 1: JP 4709017 B1

SUMMARY OF THE INVENTION

Problems to be Solved by the Invention

An object of the technology disclosed herein is to provide an excellent sound output apparatus which is used by being worn on the ears of a listener, and can realize listening characteristics of the ambient sound even in a wearing state, which are equivalent to those in a non-wearing state, and output good acoustic information at the same time.

Solutions to Problems

The technology disclosed herein has been made in light of the above problems, and a first aspect thereof is a sound output apparatus including:

a sound generation unit disposed at a back face of an ear of a listener;

a sound guiding unit whose one end is connected to the sound generation unit and the other end is disposed in an pinna of the listener, and which takes in sound generated by the sound generation unit from the one end, propagates the sound to the other end, and has an unfilled structure; and a wire connected downward.

According to a second aspect of the technology disclosed herein, the sound output apparatus according to the first aspect further includes a holding unit which holds the other end of the sound guiding unit in a vicinity of an entrance of an ear canal of the listener.

According to a third aspect of the technology disclosed herein, the holding unit of the sound output apparatus according to the first aspect is inserted into a cymba concha of the listener and locked to an intertragic notch.

According to a fourth aspect of the technology disclosed herein, the sound guiding unit of the sound output apparatus according to the third aspect is inserted through the intertragic notch in a vicinity of the other end.

According to a fifth aspect of the technology disclosed herein, the holding unit of the sound output apparatus according to the second aspect is configured to supports the sound guiding unit in a vicinity of the other end so that a sound output hole of the other end is positioned to face the ear canal.

According to a sixth aspect of the technology disclosed herein, the other end of the sound guiding unit of the sound output apparatus according to the second aspect is configured to be substantially flush with a bottom face of the holding unit.

According to a seventh aspect of the technology disclosed herein, the holding unit of the sound output apparatus according to the second aspect has a hollow structure and is configured to be coupled to the other end of the sound guiding unit at an inner periphery.

According to an eighth aspect of the technology disclosed herein, the wire of the sound output apparatus according to the first aspect is connected downward in a vicinity of a lower end of the sound guiding unit.

According to a ninth aspect of the technology disclosed herein, the sound guiding unit of the sound output apparatus according to the first aspect has a bent portion which folds back at a lower end of the pinna. Then, the wire is connected downward in a vicinity of the bent portion.

According to a tenth aspect of the technology disclosed herein, a signal line included in the wire of the sound output apparatus according to the ninth aspect is inserted through the sound guiding unit.

According to an eleventh aspect of the technology disclosed herein, the wire of the sound output apparatus according to the first aspect is connected downward to a housing of the sound generation unit.

According to a twelfth aspect of the technology disclosed herein, the sound generation unit of the sound output apparatus according to the first aspect includes a sounding element which generates a sound pressure change, and a housing which accommodates the sounding element.

According to a thirteenth aspect of the technology disclosed herein, the housing of the sound output apparatus according to the twelfth aspect includes at least one exhaust hole and a sound leakage prevention unit which prevents sound leakage from the exhaust hole.

According to a fourteenth aspect of the technology disclosed herein, the sound generation unit of the sound output apparatus according to the first aspect is configured to be detachable.

According to a fifteenth aspect of the technology disclosed herein, the holding unit of the sound output apparatus according to the second aspect includes an earpiece unit with a hollow structure, and a tongue piece unit protruding from a lower end of the earpiece unit.

According to a sixteenth aspect of the technology disclosed herein, the holding unit of the sound output apparatus according to the second aspect is configured to be detachable.

According to a seventeenth aspect of the technology disclosed herein, the wire of the sound output apparatus according to the first aspect is configured to be detachable.

Effects of the Invention

According to the technology disclosed herein, it is possible to provide an excellent sound output apparatus which is used by being worn on the ears of the listener, and can realize listening characteristics of the ambient sound even in a wearing state, which are equivalent to those in a non-wearing state, and output good acoustic information at the same time.

Note that the effects described herein are merely examples, and the effects of the present invention are not limited thereto. Moreover, in addition to the above effects, the present invention may further exert additional effects.

Still other objects, features and advantages of the technology disclosed herein will become apparent from a more detailed description based on the embodiments as described later and the accompanying drawings.

MODE FOR CARRYING OUT THE INVENTION

Hereinafter, the embodiments of the technology disclosed herein will be described in detail with reference to the drawings.

A. Apparatus Configuration

Figure 1:
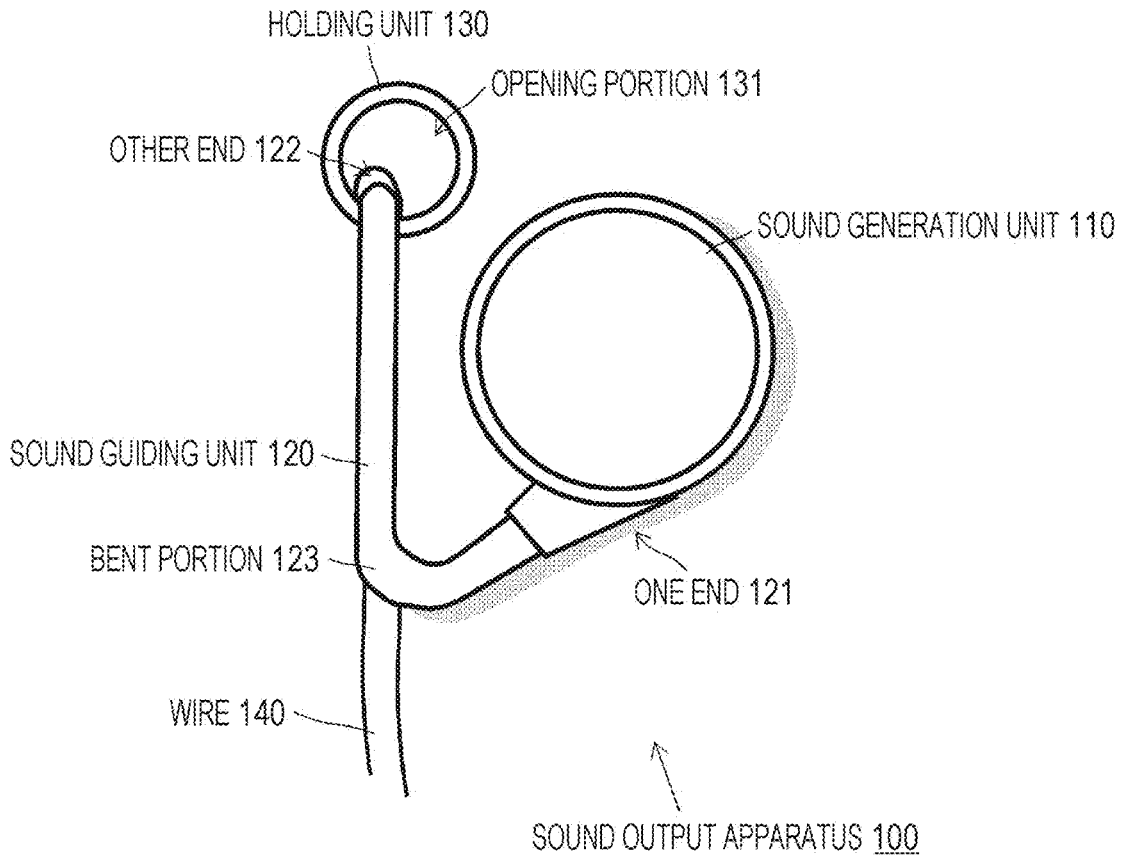
FIG. 1 is a front view of a sound output apparatus 100 (to be worn on a left ear) according to an embodiment of the technology disclosed herein.
Figure 2:
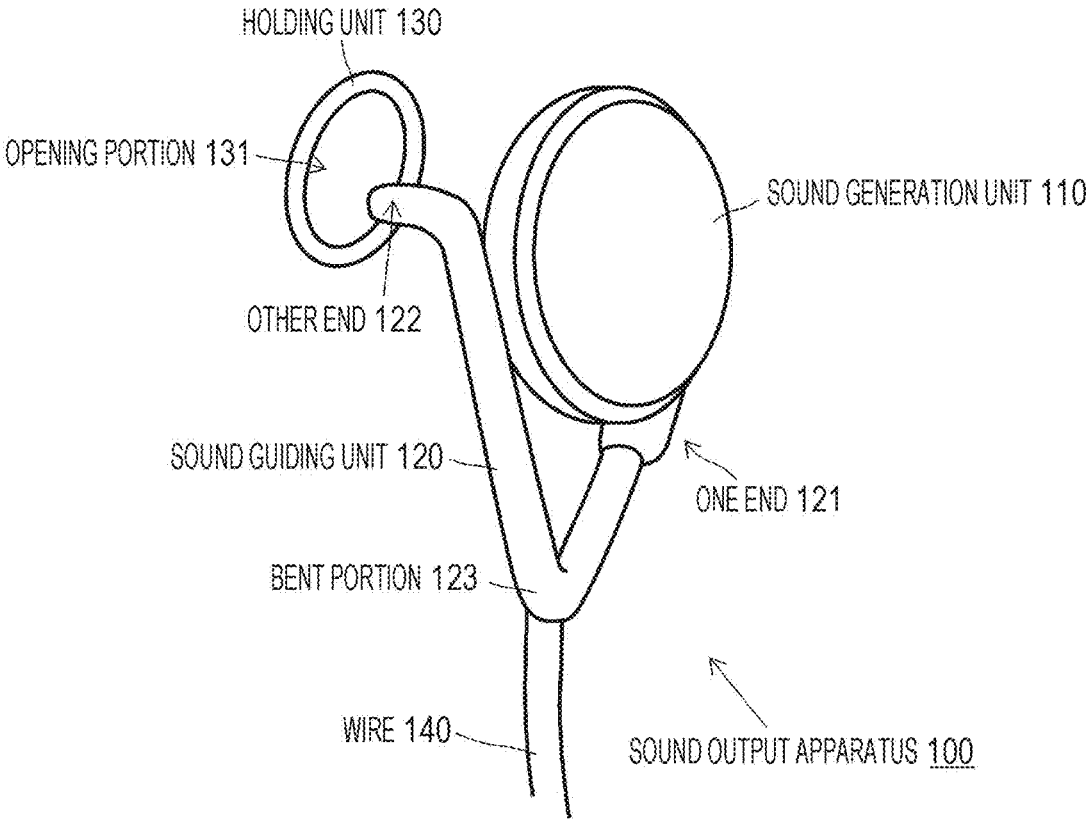
FIG. 2 is a perspective view of the sound output apparatus 100 (to be worn on a left ear) according to an embodiment of the technology disclosed herein.
Figure 3:
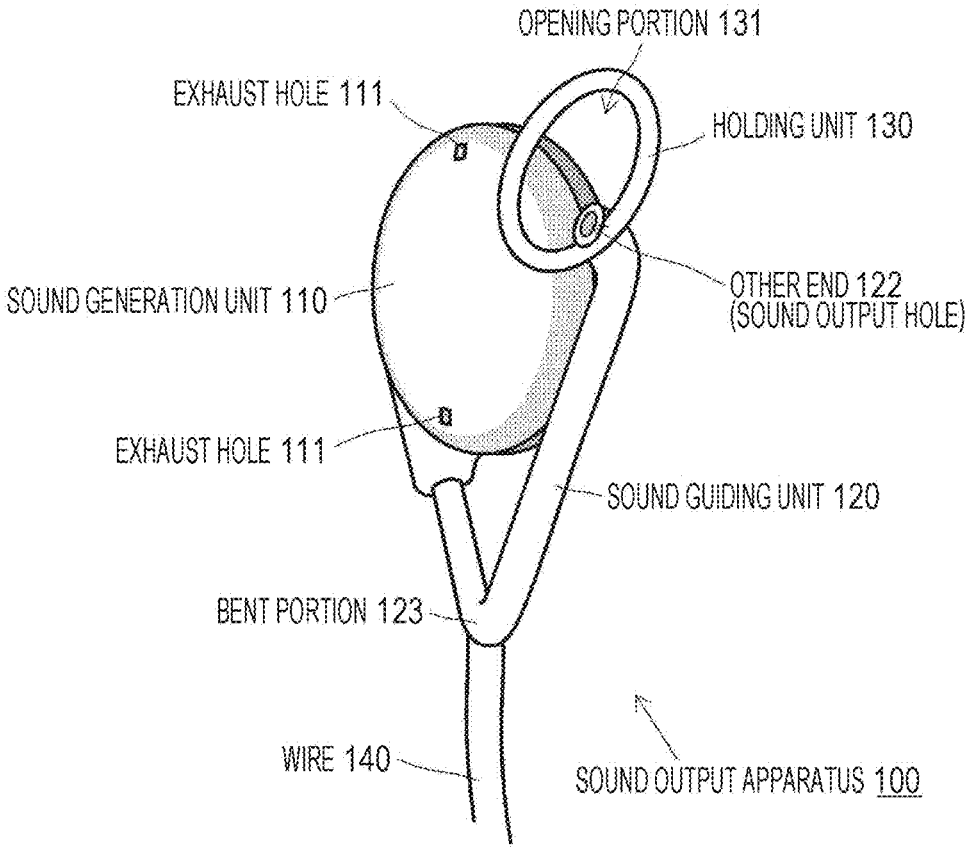
FIG. 3 is a perspective view of the sound output apparatus 100 (to be worn on a left ear) according to an embodiment of the technology disclosed herein.

FIGS. 1 to 3 show the configuration of a sound output apparatus 100 used by being worn on the ears of a listener according to an embodiment of the technology disclosed herein. It is to be noted that FIG. 1 is a front view of the sound output apparatus 100, FIG. 2 is a perspective view of the sound output apparatus 100 viewed from the left side, and FIG. 3 is a perspective view of the sound output apparatus 100 viewed from the right side. Moreover, the sound output apparatus 100 shown in FIGS. 1 to 3 is configured to be worn on the left ear, but it should be understood that a sound output apparatus (not shown) to be worn on the right ear is configured to be bilaterally symmetric thereto.

The sound output apparatus 100 includes a sound generation unit 110 which generates sound, a sound guiding unit 120 which takes in, from one end 121, the sound generated from the sound generation unit 110, and a holding unit 130 which holds the sound guiding unit 120 in the vicinity of the other end 122.

Since the sound generation unit 110 utilizes a sounding element (as described later), such as a speaker, which produces a sound pressure change, an atmospheric pressure change occurs in a housing of the sound generation unit 110 when the sound is generated. As shown in FIG. 3, at least one exhaust hole 111 for a case where high atmospheric pressure generated in the housing is generated is drilled on the back side of the housing.

The sound guiding unit 120 includes an unfilled (e.g., cylindrical) tube material with an inner diameter of 1 to 5 mm, and both ends thereof are open ends. The one end 121 of the sound guiding unit 120 is a sound input hole for the sound generated from the sound generation unit 110, and the other end 122 is a sound output hole thereof. Therefore, by attaching the one end 121 to the sound generation unit 110, the sound guiding unit 120 is in one side open state. For example, the sound guiding unit 120 can be created by an elastic resin such as an elastomer.

The tube-like sound guiding unit 120 has a bent portion 123 at an intermediate part and has a bent shape folded back from the back side of the pinna to the front side. As will be described later, when the sound output apparatus 100 is attached to the ear of a listener, the sound output hole of the sound guiding unit 120 is positioned in the vicinity of the entrance of the ear canal by the holding unit 130, while the sound generation unit 110 is positioned at the rear side of the pinna. The sound guiding unit 120 folds back at the lower end of the pinna due to the bent shape and can propagate the aerial vibration taken in from the one end 121 at the rear side of the pinna to the front side of the pinna.

Figure 4:
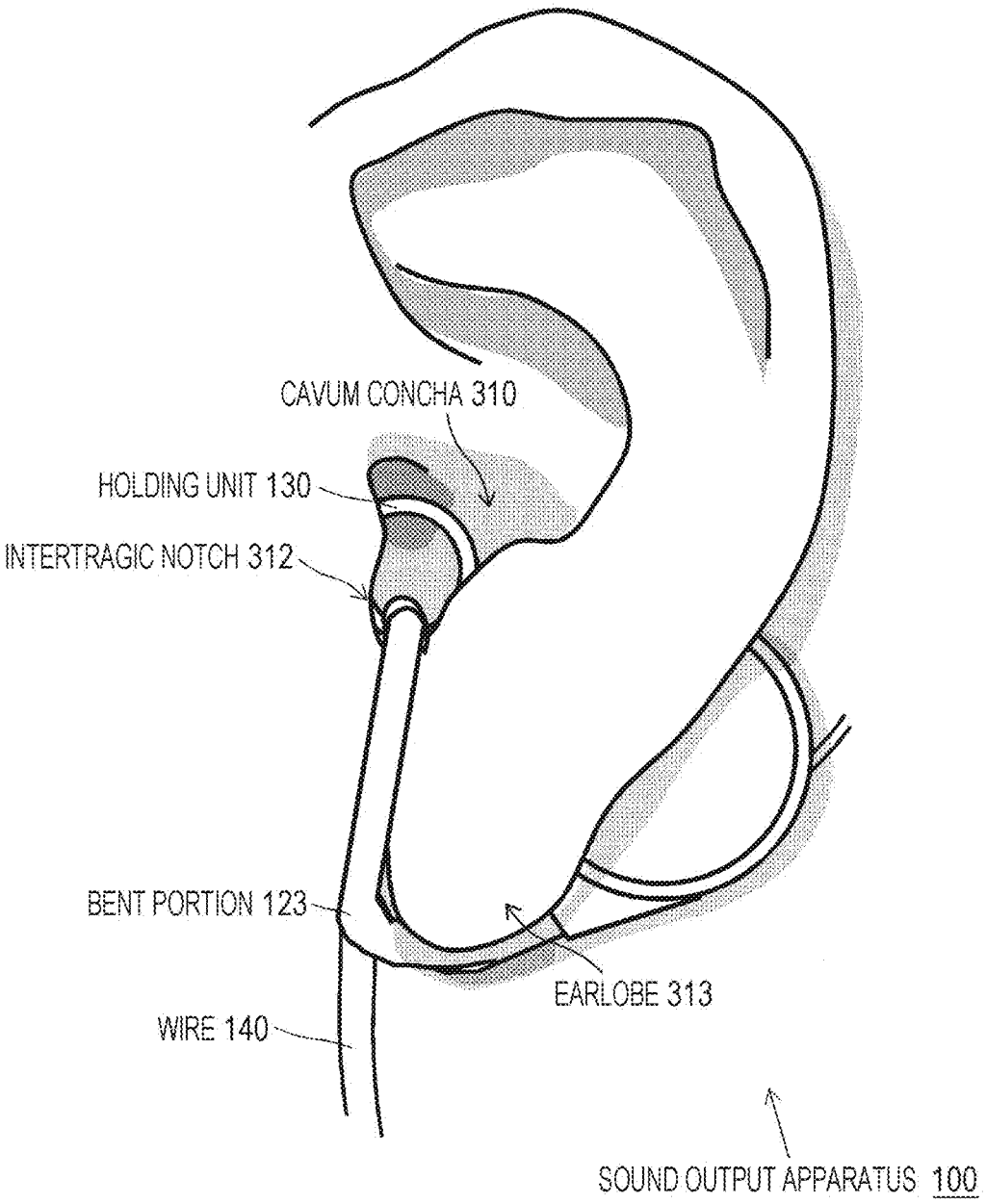
FIG. 4 is a view showing a state in which the sound output apparatus 100 according to the present embodiment is worn on the left ear of a listener.

The holding unit 130 includes a ring-shaped structure body and coupled to the other end 122 of the sound guiding unit 120 at the inner periphery of the ring. As shown in FIG. 4, the holding unit 130 is inserted into, for example, a cavum concha 310 which is one of the recesses of the pinna, and the coupled portion to the other end 122 of the sound guiding unit 120 is hooked on an intertragic notch 312 to be locked so that the sound output apparatus 100 is worn on the pinna. In a state in which the holding unit 130 is hooked on the intertragic notch 312 in this manner, the holding unit 130 can support the vicinity of the other end 122 of the sound guiding unit 120 so that the sound output hole of the other end 122 of the sound guiding unit 120 is positioned to face the ear canal.

The holding unit 130 is, for example, a ring-shaped structure body with an outer diameter of about 13.5 mm. However, the holding unit 130 is not limited to the ring-shaped structure and may have any shape that has a hollow structure and can couple the other end 122 of the sound guiding unit 120 to the inner periphery to support. The holding unit 130 can be said to be a component corresponding to a conventional earpiece, but can be created by, for example, an elastic resin such as an elastomer.

The outer diameter of the vicinity of at least the other end 122 of the sound guiding unit 120 is formed so as to be much smaller than the inner diameter of the ear hole. In addition, the holding unit 130 has an opening portion 131 which opens the ear canal entrance (ear hole) to the outer world even in the state holding the sound guiding unit 120. In the examples shown in FIGS. 1 to 3, the vicinity of the other end 122 of the sound guiding unit 120, which is the sound output hole, is coupled to the inner periphery of the ring-shaped holding unit 130, and the ring-shaped structure body is almost entirely the opening portion 131. Therefore, even in a state in which the holding unit 130 supporting the other end 122 of the sound guiding unit 120 is inserted into the cavum concha 310, the ear hole of the listener is not closed. That is, the ear hole is opened. Unlike the conventional earphones, the sound output apparatus 100 can be said to be a "ear-hole open type."

Once the tube-like sound guiding unit 120 takes in the sound generated from the sound generation unit 110 into the tube from the one end 121 thereof, the aerial vibration is propagated, emitted toward the ear canal from the other end 122 held by the holding unit 130 in the vicinity of the entrance of the ear canal and conveyed to the eardrum.

Figure 27:
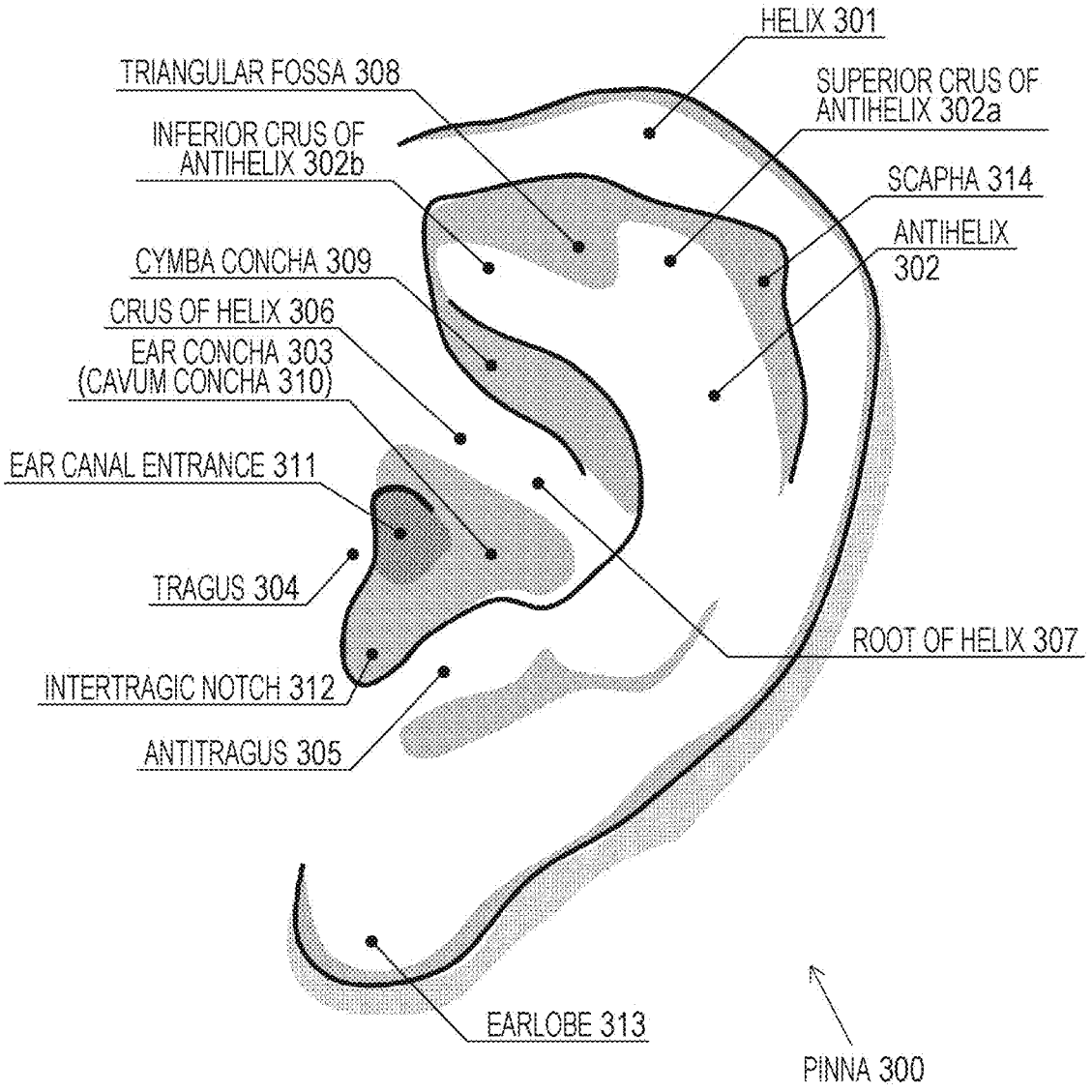
FIG. 27 is a view showing the shape of the pinna and the names of its components.

FIG. 4 shows a state in which the sound output apparatus 100 according to the present embodiment is worn on the left ear of a listener. For reference, the shape of the pinna and the name of each part are shown in FIG. 27.

As shown in FIG. 4, the holding unit 130 coupled to the vicinity of the other end 122 of the sound guiding unit 120 is preferably inserted into the cavum concha 310 and abuts the bottom face of the cavum concha 310 as well as the coupled portion to the other end 122 of the sound guiding unit 120 is hooked on the intertragic notch 312 to be locked to the pinna. In addition, in a state of being hooked on the intertragic notch 312 in this manner, the holding unit 130 supports the vicinity of the other end 122 of the sound guiding unit 120 so that the sound output hole of the other end 122 of the sound guiding unit 120 is positioned to face the ear canal.

In addition, the holding unit 130 has a hollow structure, and the inner side thereof is almost entirely the opening portion 131. Therefore, even in a state in which the holding unit 130 is inserted into the cavum concha 310, the ear hole of the listener is not closed. That is, the ear hole is opened. Unlike the conventional earphones, the sound output apparatus 100 can be said to be a "ear-hole open type."

The holding unit 130 is, for example, a ring-shaped structure body with an outer diameter of about 13.5 mm (previously mentioned). The size of the outer diameter of the holding unit 130 affects the wearing stability to the intertragic notch 312 as well as the wearing sense (comfort). There are individual differences in the size of the cavum concha 310, and there are many people who cannot insert the holding unit 130 into the cavum concha 310 if the outer diameter (or the width) of the holding unit 130 is made longer than 16 mm.

Moreover, for the purpose of propagating the aerial vibration, the sound guiding unit 120 preferably has an inner diameter as long as possible. On the other hand, as shown in FIG. 4, the sound guiding unit 120 is inserted through the intertragic notch 312 in the vicinity of the other end 122 thereof. Therefore, if the outer diameter of the sound guiding unit 120 is made equal to or longer than the gap of the intertragic notch 312 (e.g., 3.6 mm), there is a concern that a sense of pressure will be given to the ear (intertragic notch 312) of a wearer.

The sound generation unit 110 is disposed on the rear side of the pinna 402 and coupled to the one end 121 of the sound guiding unit 120. The sound guiding unit 120 folds back at the lower end of the pinna by the bent portion 123 and can propagate the aerial vibration taken in from the one end 121 at the rear side of the pinna to the front side of the pinna.

Since an earlobe 313 is relatively small, the distance from the sound generation unit 110 installed at the rear side of the pinna, folding back at and passing the earlobe 313 and reaching the entrance of the ear canal is short, and the length of the sound guiding unit 120 is short accordingly. By folding back at the place shortest from the entrance of the ear canal, the length of the sound guiding unit 120 can be the shortest distance. The length of the sound guiding unit 120 is, for example, about 40 mm. When the sound propagation length is short, the attenuation of the sound of the sound generation unit 110 taken in from the one end 121 until the sound is outputted from the other end 122 is small. Thus, even if the output of the sound generation unit 110 is suppressed to be small, sufficient sound quality can be obtained.

Incidentally, if the sound guiding unit 120 is configured to pass the upper half of the pinna (not shown), the distance from the sound generation unit 110 installed at the rear side of the pinna, passing the upper end of a helix 301 and reaching the entrance of the ear canal becomes long since the upper half of the pinna is wider than the earlobe 313. The length of the sound guiding unit 120 also becomes longer accordingly, and the attenuation amount of the sound generated from the sound generation unit 110 until the sound is emitted to the ear canal also increases, or the output of the sound generation unit 110 needs to be increased. In addition, the sound guiding unit 120 must passes over the complicated irregular shape caused by the shape of the auricular cartilage in the order of an ear concha 303, an antihelix 302, a scapha 314 and the helix 301 toward the outer side of the pinna so that the attachment to the pinna becomes unstable. That is to say, as compared with the earlobe 313, there are great individual differences in the size of the helix 301 at the upper half of the pinna. Thus, when trying to pass the upper half of the pinna, the length of the sound guiding unit 120 needs to be adjusted, causing a problem that the designing becomes troublesome.

As can be also seen from FIG. 4, the holding unit 130 has a hollow structure, and the ear hole is opened to the outer world through the opening portion 131 even in a state in which the holding unit 130 is inserted into the cavum concha 310. Therefore, the listener can sufficiently listen to the ambient sound through the opening portion 131 even while the listener wears the sound output apparatus 100 and listens to the sound outputted from the sound generation unit 110. Unlike the conventional earphones, the sound output apparatus 100 can be said to be a "ear-hole open type."

Moreover, although the sound output apparatus 100 according to the present embodiment opens the ear hole, it is possible to prevent leakage of the sound generated (the sound reproduced) from the sound generation unit 110 to the outside. This is because the other end 122 of the sound guiding unit 120 is attached so as to face the ear canal and emits the aerial vibration of the generated sound in the vicinity of the eardrum so that sufficient sound quality can be obtained even if the output of the sound output unit 100 is reduced.

Figure 5:
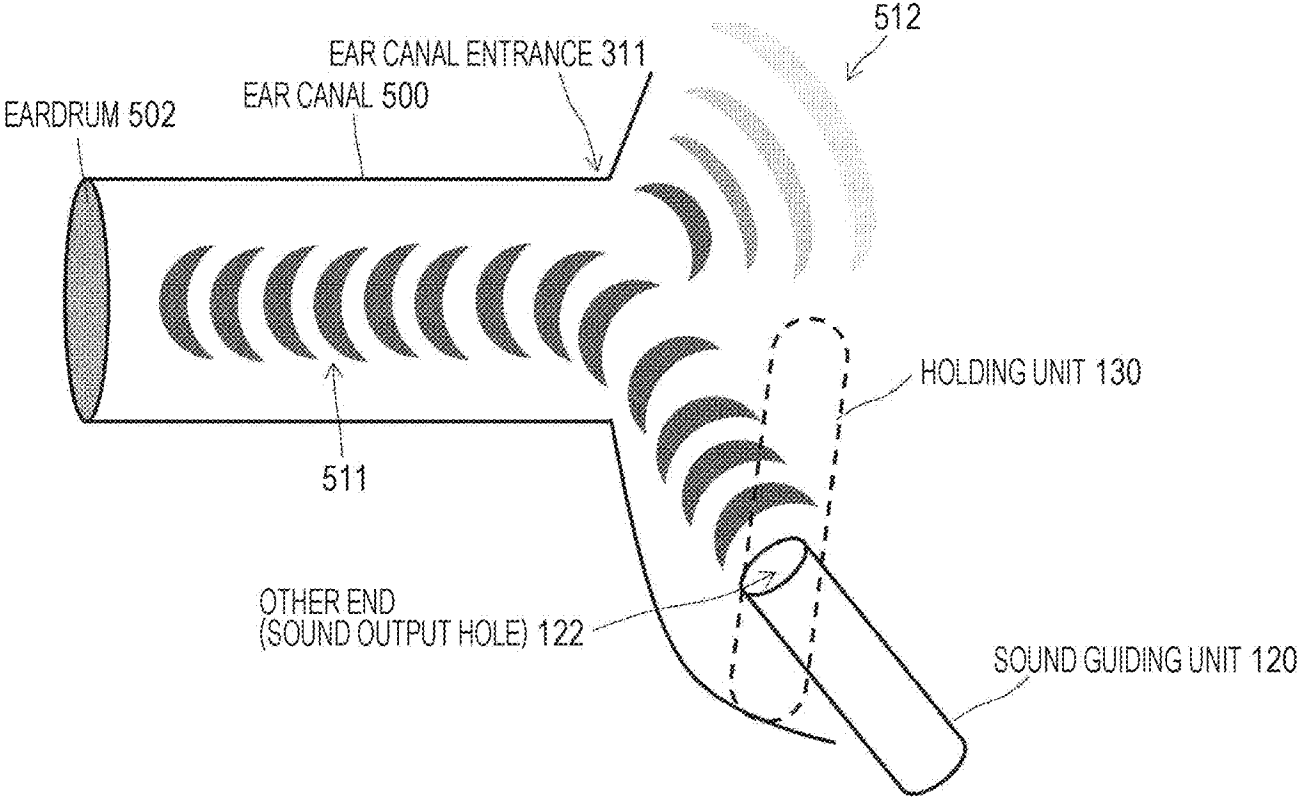
FIG. 5 is a view showing a state in which the sound output apparatus 100 of an ear-hole open type outputs sound waves to the ear of a listener.

Furthermore, the directivity of the aerial vibration emitted from the other end 122 of the sound guiding unit 120 also contributes to the prevention of the sound leakage. FIG. 5 shows a state in which the sound output apparatus 100 of the ear-hole open type outputs sound waves to the ear of a listener. The aerial vibration is emitted from the other end 122 of the sound guiding unit 120 toward the inside of the ear canal. An ear canal 500 is a hole, which starts from an ear canal entrance 501 and ends at the inner side of the eardrum 502, and generally has a length of about 25 to 30 mm. The ear canal 500 is a tubular closed space which presents an S-shaped curve. Therefore, the aerial vibration emitted from the other end 122 of the sound guiding unit 120 toward the interior of the ear canal 500 propagates to the eardrum 502 with directivity as indicated by the reference numeral 511. In addition, as for the aerial vibration, since the sound pressure rises in the ear canal 500, the sensitivity in the low frequency range (gain) is improved. On the other hand, the outside, that is, the outer world of the ear canal 500 is an open space. Therefore, the aerial vibration emitted from the other end 122 of the sound guiding unit 120 to the exterior of the ear canal 500 has no directivity and steeply attenuates as indicated by the reference numeral 512 when the aerial vibration is released to the outer world.

Strictly speaking, in a state in which the holding unit 130 is locked to the intertragic notch 312, the other end 122 of the sound guiding unit 120, which is the sound output hole, is rather opposed to the cavum concha 310, not in the vicinity of the ear canal entrance 311. Thereupon, the holding unit 130 obliquely inclines the other end 122 of the sound guiding unit 120 to support so that so that the sound output hole faces the ear canal entrance 311. This is because it is extremely important that the emission direction of the sound from the other end 122 of the sound guiding unit 120 and the hole direction of the ear canal coincide with each other in order to maintain the sensitivity of the low frequency components. On the other hand, if the other end 122 of the sound guiding unit 120 is supported by the holding unit 130 to face horizontally, most of the aerial vibration emitted from the other end 122 is reflected by the cavum concha 310 and becomes difficult to be propagated into the ear canal 500.

Figure 6A:
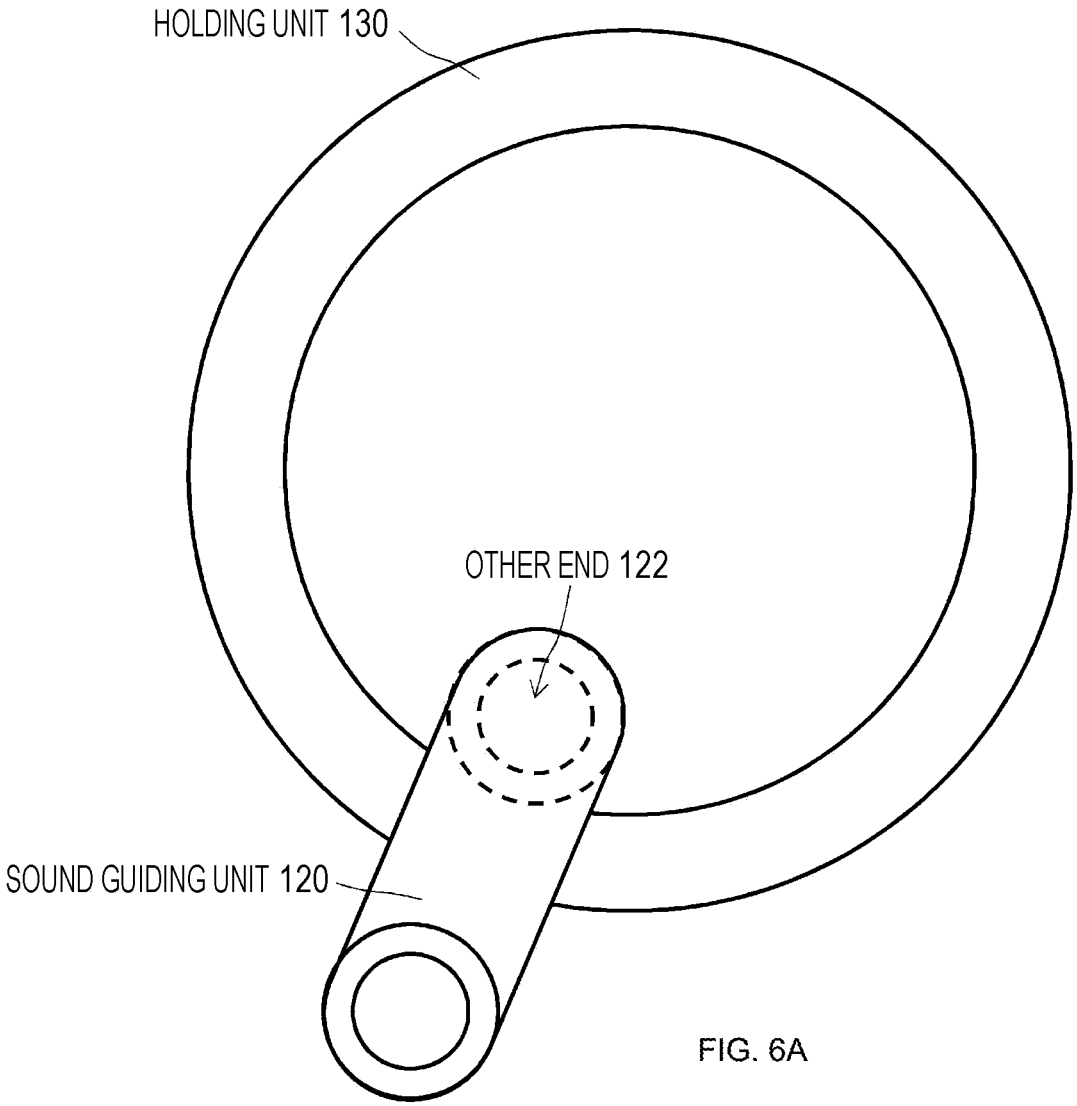
FIGS. 6A and 6B are top views and cross-sectional views of a holding unit 130 coupled to the vicinity of the other end 122 of a sound guiding unit 120 coupled to the holding unit 130.
Figure 6B:
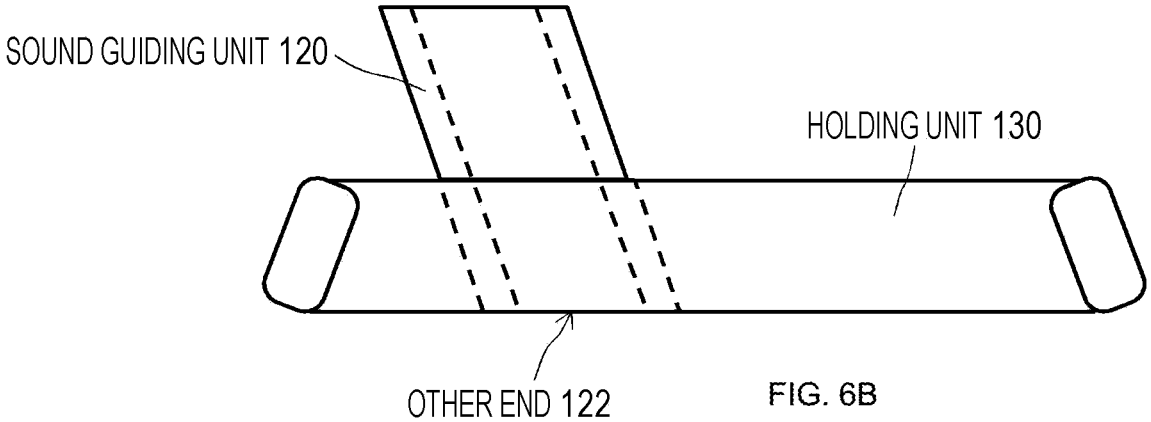
Figure 7:
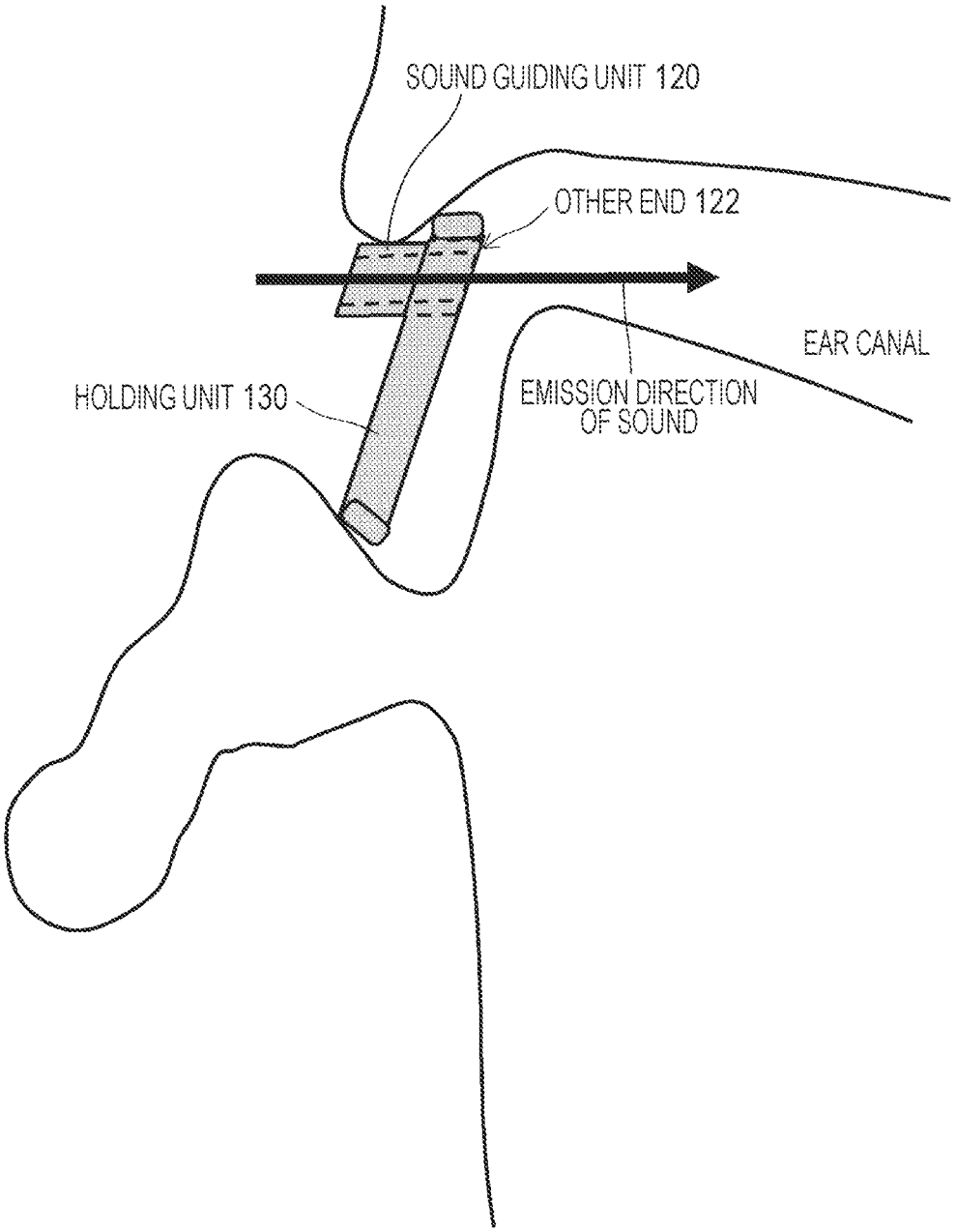
FIG. 7 is a view showing a horizontal cross section of the head of a wearer where the holding unit 130 is locked to an intertragic notch 312 of the left ear.

FIGS. 6A and 6B respectively show a top view and a cross-sectional view of the holding unit 130 coupled to the vicinity of the other end 122 of the sound guiding unit 120. In addition, FIG. 7 shows a horizontal cross-section of the vicinity of the left ear of the head of a wearer where the holding unit 130 is locked to the intertragic notch 312 of the left ear.

For example, the holding unit 130 is inserted into the cavum concha 310, and the coupled portion to the other end 122 of the sound guiding unit 120 is hooked on the intertragic notch 312 to be locked. Then, as can be seen from FIG. 7, the holding unit 130 is inclined from the hole direction of the ear canal when locked to the inner wall of the intertragic notch 312, but the sound output hole of the other end 122 of the sound guiding unit 120 is positioned to face the ear canal. That is, the emission direction of the sound from the other end 122 of the sound guiding unit 120 and the hole direction of the ear canal coincide with each other.

Figure 8:
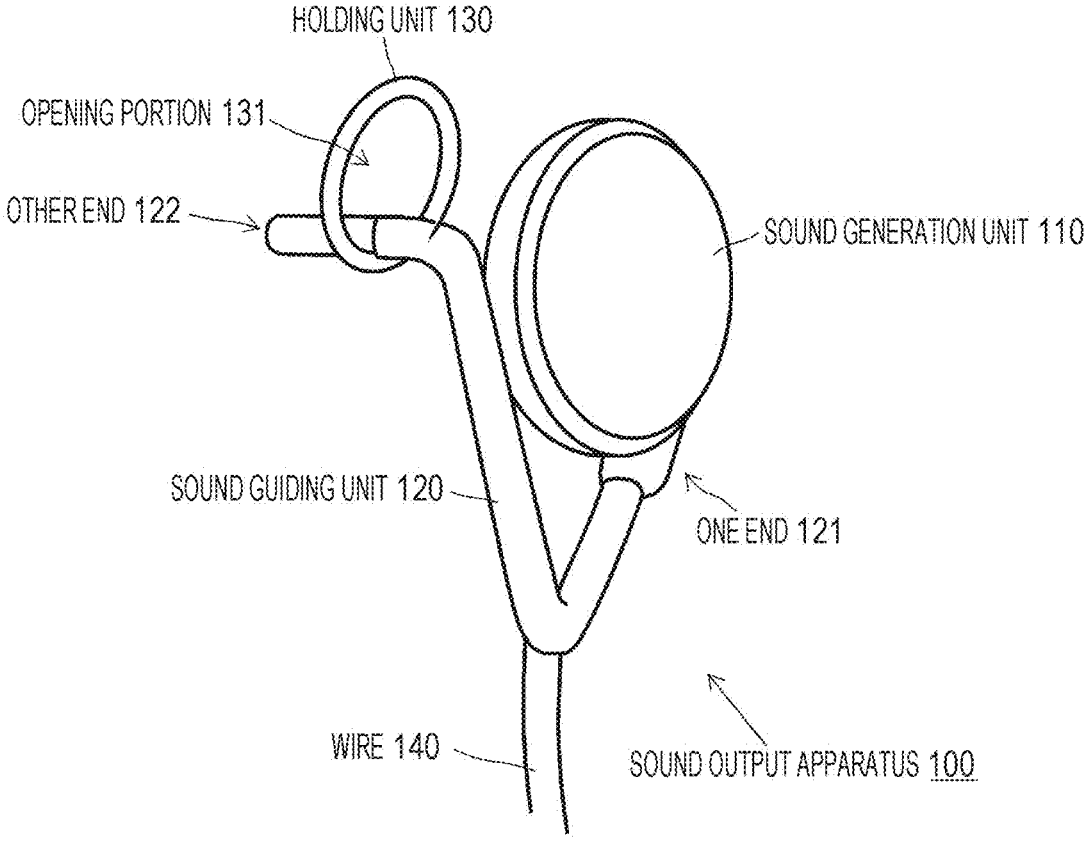
FIG. 8 is a view showing a modification example of the sound output apparatus 100.
Figure 9:
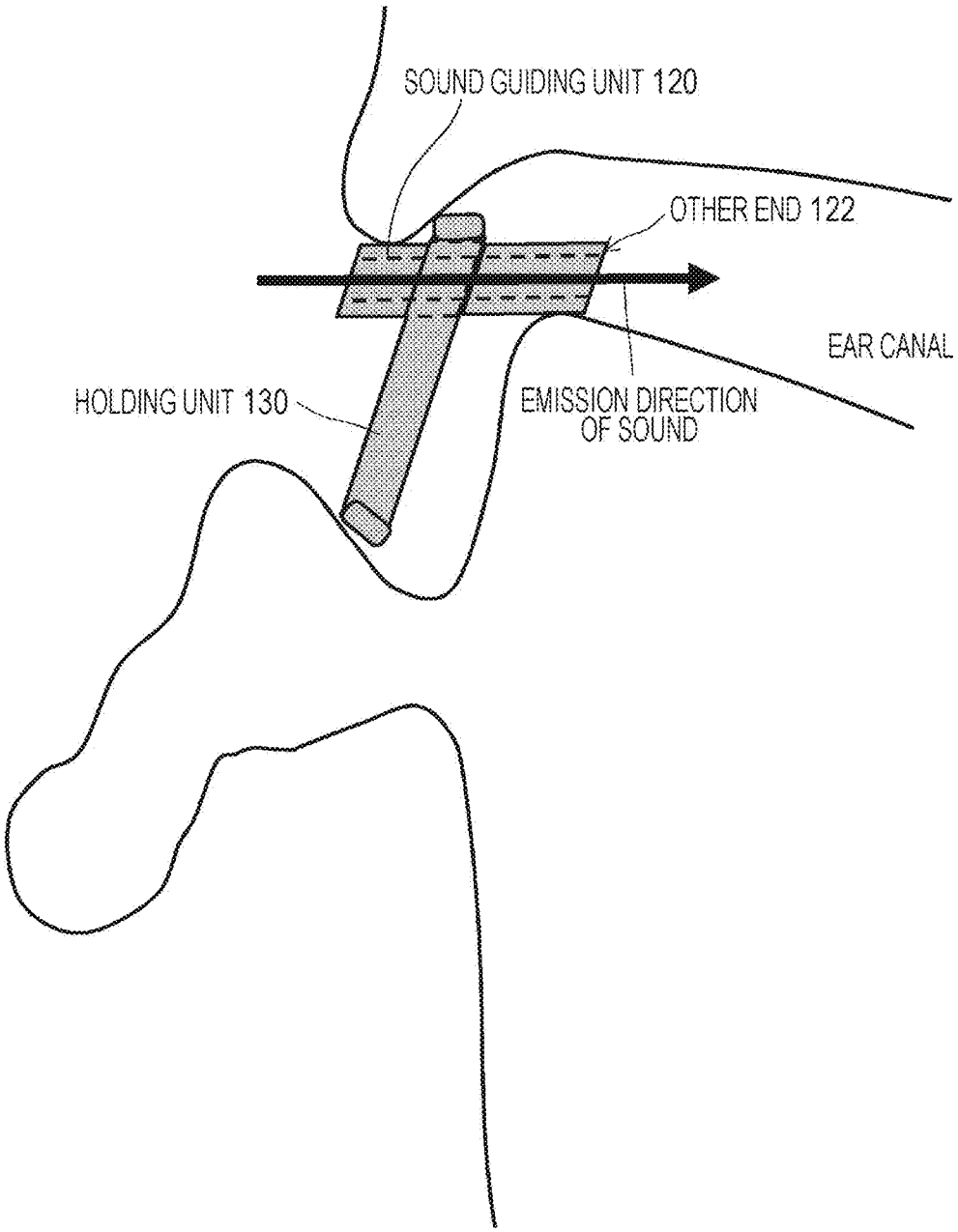
FIG. 9 is a view showing a modification example of the sound output apparatus 100.

Note that, in consideration of the acoustic effects, as shown in FIGS. 8 and 9, a configuration example, in which the other end 122 of the sound guiding unit 120 protrudes from the holding unit 130 and the sound output hole is provided at a place closer to the ear canal entrance, can be considered. However, if the holding unit 130 from which the other end 122 of the sound guiding unit 120 protrudes is to be worn on the pinna (cavum concha) 310, a sense of fear of piercing the ear is given to the wearer. On the other hand, according to the embodiment shown in FIGS. 6A, 6B, and 7, the other end 122 of the sound guiding unit 120 is substantially flush with the bottom face of the holding unit 130 and does not protrude. Thus, a sense of fear of a sharp object piercing the ear is not given. Moreover, since the emission direction of the sound from the other end 122 of the sound guiding unit 120 substantially faces the hole direction of the ear canal, sufficient acoustic effects can be obtained even if the sound output hole is slightly away from the ear canal entrance.

A wire 140, which inputs an audio signal from an audio reproducing apparatus (not shown) into the sound generation unit 110, is connected to the sound output apparatus 100 again described with reference to FIGS. 1 to 4. Note that the sound reproducing apparatus is, for example, a music player, a smartphone, a tablet terminal, or the like. Moreover, there is also a case where an audio signal is inputted from not the audio reproducing apparatus, but a receiver (not shown) which receives a wireless signal from the audio reproducing apparatus, into the sound generation unit 110.

Figure 10:
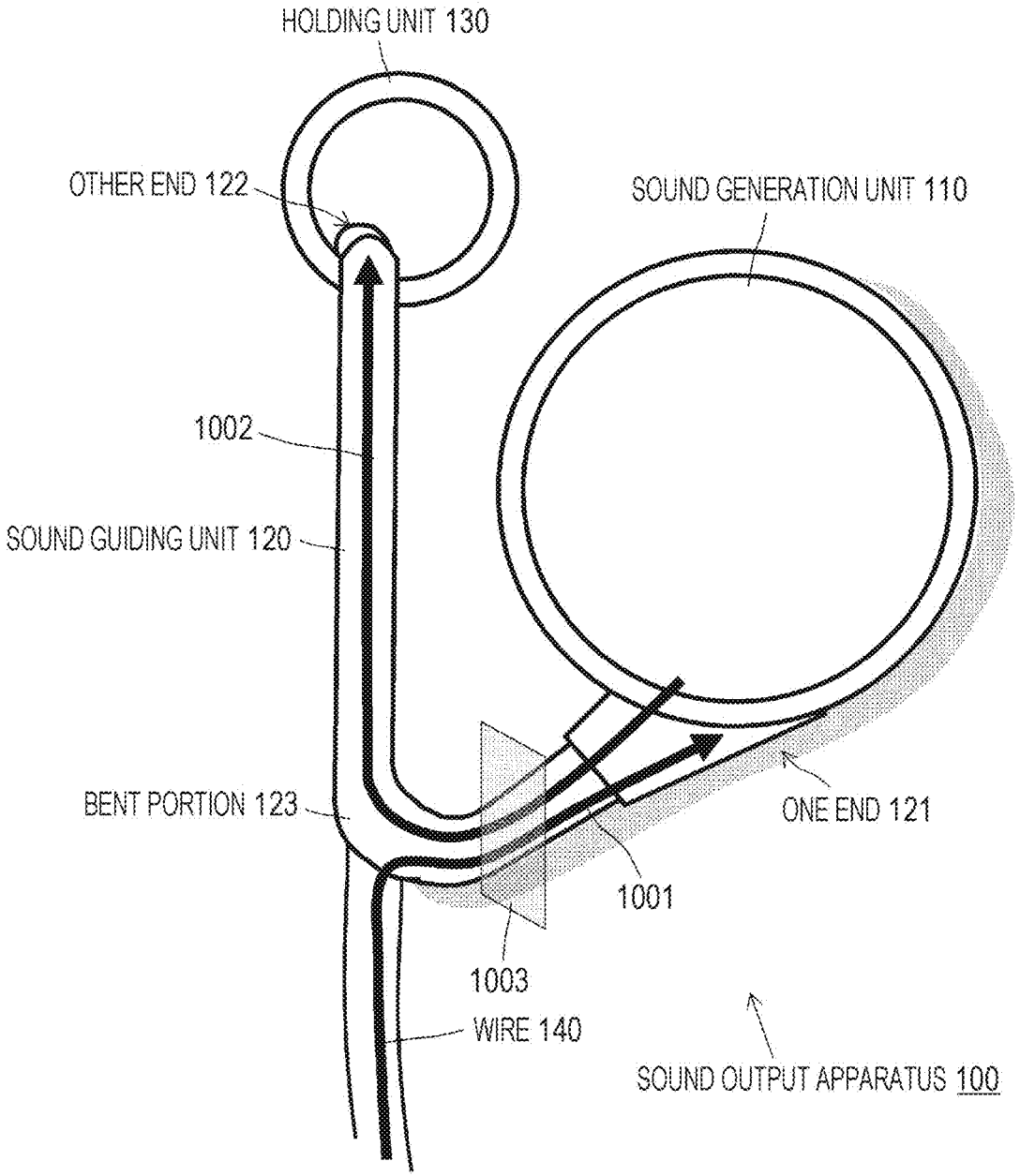
FIG. 10 is a view showing a state in which a wire 140 is inserted through the sound guiding unit 120.

The wire 140 is connected downward in the vicinity of the bent portion 123 of the sound guiding unit 120. In the present embodiment, the sound guiding unit 120 is used as a sound wave propagation path as well as a conduit. As shown in FIG. 10, an electric signal line included in the wire 140 is inserted through the sound guiding unit 120 from the bent portion 123 and connected to the sound generation unit 110 as indicated by the reference numeral 1001. On the other hand, as indicated by the reference numeral 1002, the aerial vibration generated in the sound generation unit 110 is taken in from the one end 121 of the sound guiding unit 120 and emitted from the other end 122 after the traveling direction is folded back at the bent portion 123.

Figure 11:
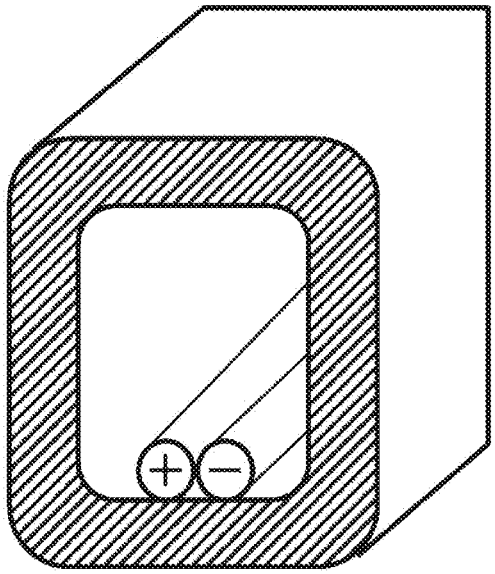
FIG. 11 is a view showing a cross section of the sound guiding unit 120 through which a signal line of the wire 140 is inserted.

FIG. 11 shows a state in which the signal line of the wire 140 is inserted through the sound guiding unit 120 with a cross section indicated by the reference numeral 1003 in FIG. 10. By making the sound guiding unit 120 common to the conduit, the inner diameter of the sound guiding unit 120 can be effectively utilized, and the tube diameter can be maximized. Alternatively, a manufacturing method of insert molding an electric wire into a mold may be used. On the other hand, it is inefficient to pass the signal line through a passage different from the sound guiding unit 120.

Figure 12:
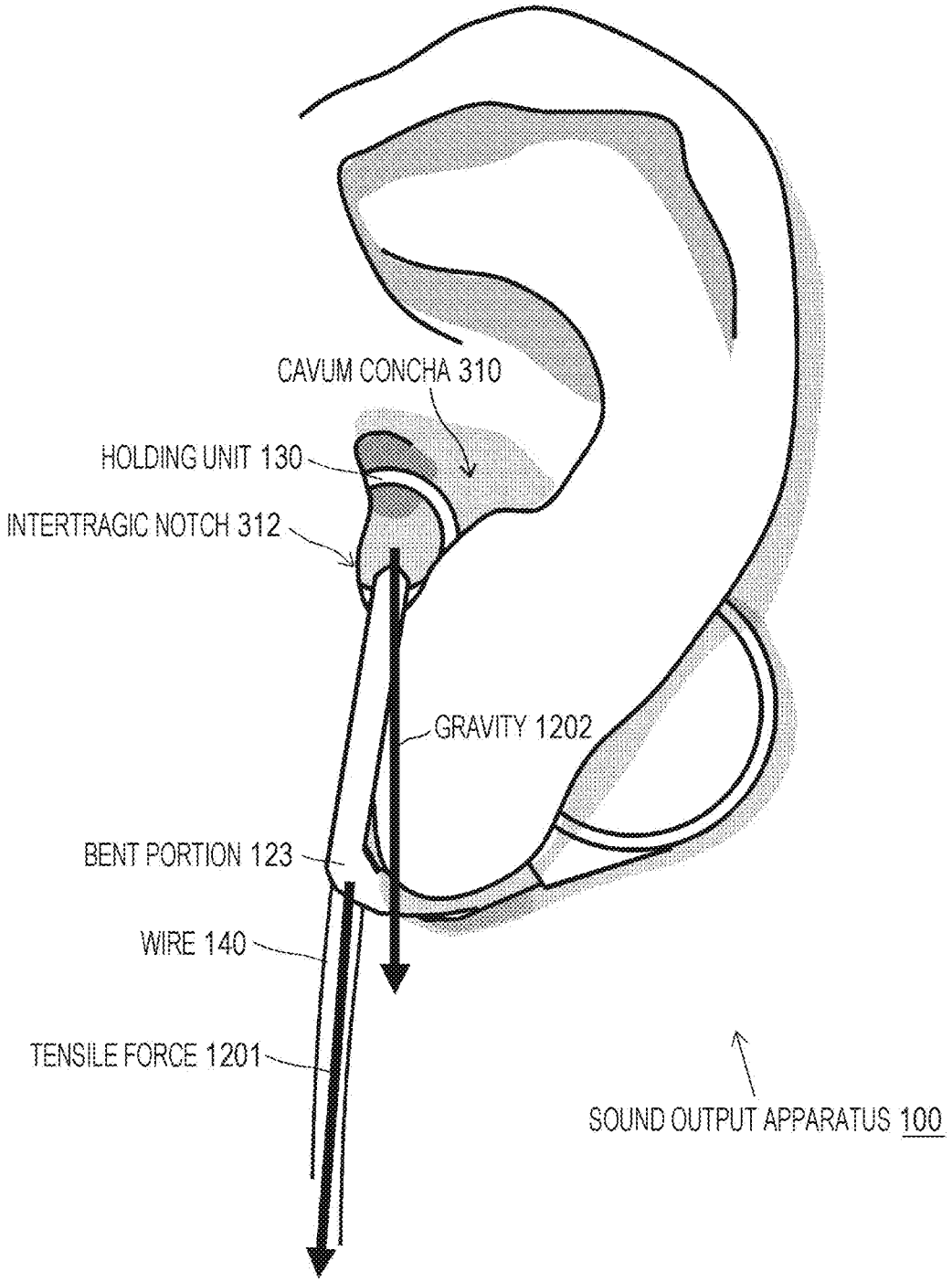
FIG. 12 is a view showing a tensile force acting on the wire 140.

Furthermore, in a case where the wire 140 is connected downward in the vicinity of the bent portion 123 of the sound guiding unit 120, there is also an advantage that the wearing stability of the sound output apparatus 100 is improved. As indicated by the reference numeral 1201 in FIG. 12, a tensile force of the downward wire 140 is applied to the vicinity of the bent portion 123 of the sound guiding unit 120. On the other hand, gravity is applied to the holding unit 130 locked to the intertragic notch 312 as indicated by the reference numeral 1202. As shown in the drawing, as a result of the tensile force 1201 acting in a direction approximate to the gravity 1202, the lower end of the holding unit 130 is pressed against the bottom portion of the cavum concha 310, and the wearing stability of the holding unit 130 on the intertragic notch 312 increases. c Even if the normally assumed tensile force 1201 is applied to the wire 140, the holding unit 130 will not fall off from the intertragic notch 312.

In the art, "Shure hanging" which hooks the wires from the upper parts of the pinnae to the rears of the ears is known as a method of hooking the wires, which makes it difficult for the earphones to fall off from the pinnae. The inner ear type earphones and the canal type earphones have an advantage that they are difficult to be fallen off from the pinnae by Shure hanging. On the other hand, in the case where the holding unit 130 is configured to be locked to the intertragic notch 312 as in the present embodiment, when the wire is Shure-hung, a force in a direction substantially opposite to the gravity acts on the holding unit 130. Thus, the earphones rather loosen from the intertragic notch 312 and are prone to fall off.

Note that the sound guiding unit 120 has the bent shape which folds back from the back side to the front side of the pinna at the intermediate part, but this bent portion makes the holding unit 130 and the housing of the sound generation unit 110 sandwich the pinna with reference to FIG. 4. In a case where the tensile force 1202 acting on the wire 140 does not completely coincide with the direction of the gravity 1201 applied to the holding unit 130 (or the entire sound output apparatus 100), a moment works, and the sound output apparatus 100 tries to rotate. However, the housing of the sound generation unit 110 abuts the wall face on the rear side of the pinna to prevent the rotation so that the falling off is prevented.

Figure 13:
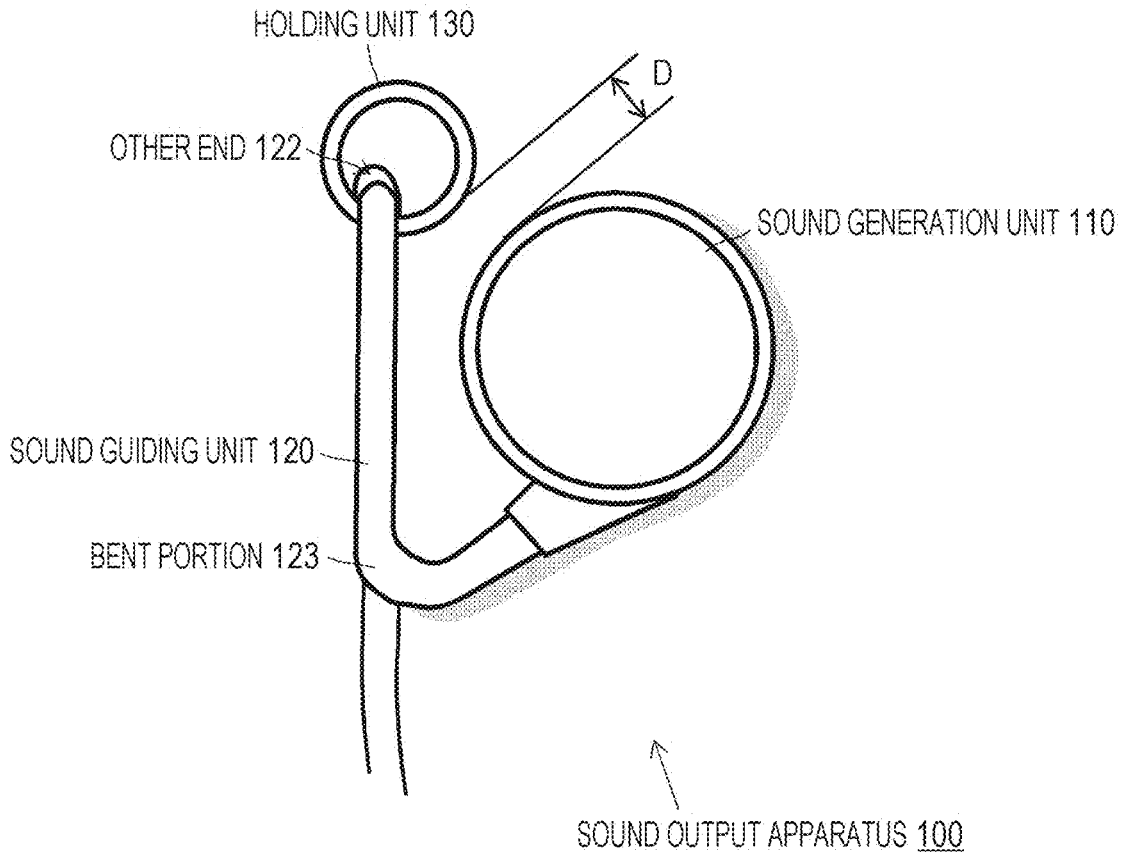
FIG. 13 is a view for explaining the configuration for preventing the sound output apparatus 100 from falling off.

Herein, as shown in FIG. 13, when a distance D between the holding unit 130 and the sound generation unit 110 is too short, the forces of the holding unit 130 and the sound generation unit 110 to grip the pinna becomes too strong. Thus, the housing of the sound generation unit 110 is pressed against the rear side of the pinna and hurts the wearer. On the contrary, when the distance D is too long, the forces of the holding unit 130 and the sound generation unit 110 to grip the pinna becomes weak. Thus, the sound output apparatus 100 is prone to fall off. Roughly speaking, the distance D is preferably not less than 6.5 mm and not more than 8.5 mm. For example, the distance D should be set to 7.5 mm.

Subsequently, the sound generation unit 110 will be described in detail. The principle that the sound generation unit 110 generates sound can be any. Herein, the structure of the sound generation unit 110, which utilizes the sounding element such as a speaker that produces a sound pressure change, will be described.

Figure 14:
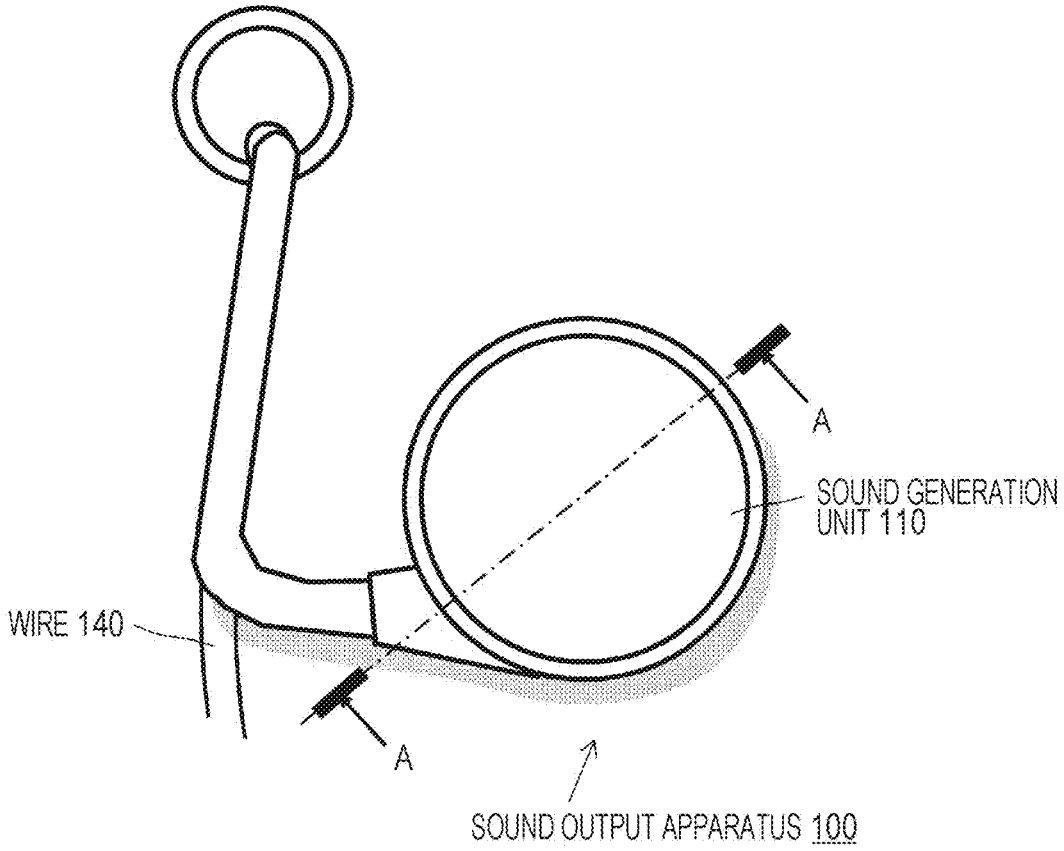
FIG. 14 is a view showing a state in which the sound generation unit 110 is viewed from the front.
Figure 15:
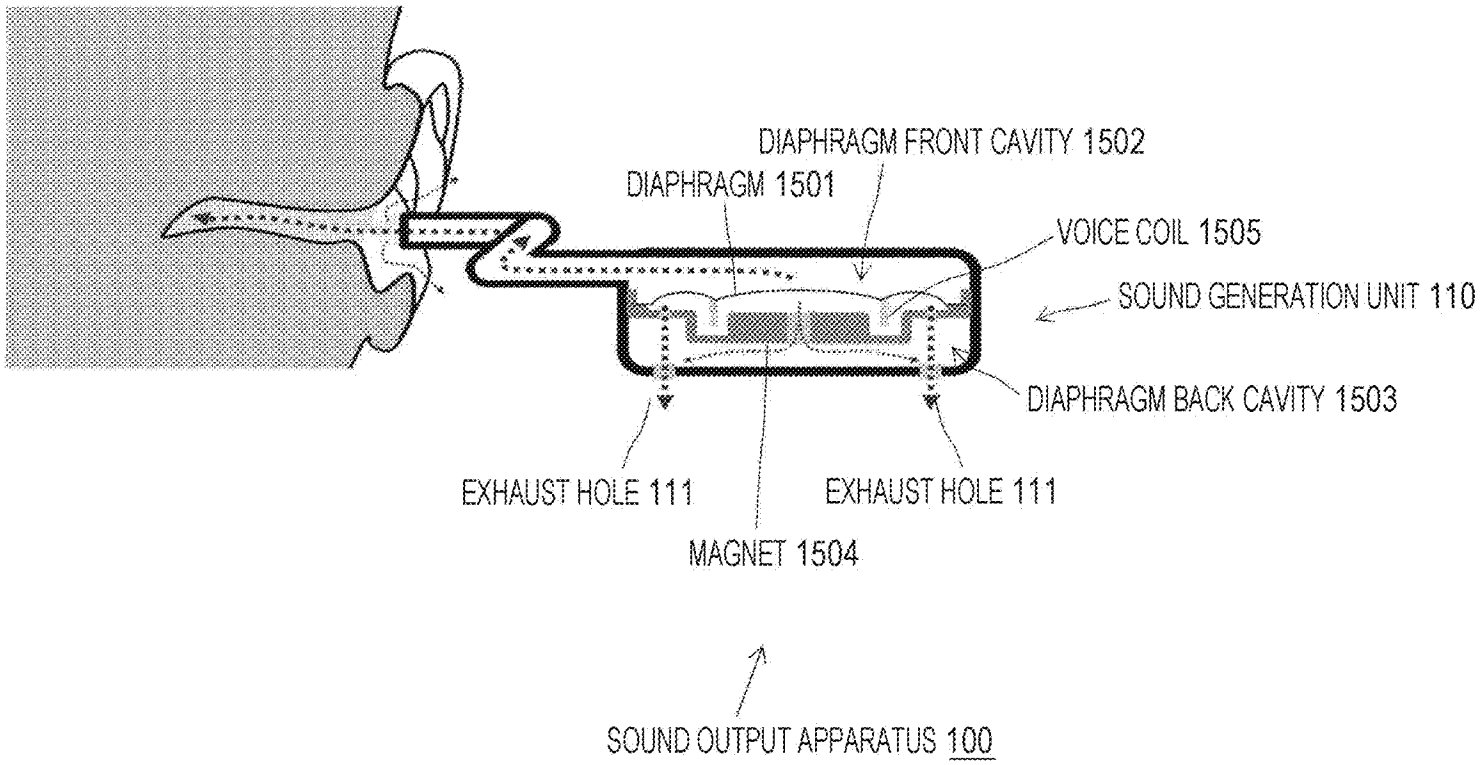
FIG. 15 is a view showing a cross section A-A of the sound generation unit 110.

FIG. 14 shows a state in which the sound generation unit 110 is viewed from the front. In addition, FIG. 15 shows a A-A cross-sectional view of the sound generation unit 110. The sound generation unit 110 shown in FIGS. 14 and 15 is a so-called dynamic type speaker.

As shown in FIG. 15, a diaphragm 1501 having a voice coil 1505 is positioned inside the sound generation unit 110 and opposes a magnetic circuit constituted by a magnet 1504. Moreover, the inside of the sound generation unit 110 is partitioned by this diaphragm 1501 into a diaphragm front cavity 1502 (front cavity) and a diaphragm back cavity 1503 (back cavity). Then, when the magnetic field changes according to the audio signal inputted into the voice coil 1505 via the cable 140, the diaphragm 1501 moves back and forth by the magnetic force of the magnet 1504. Thereby, an atmospheric pressure change occurs between the diaphragm front cavity 1502 and the diaphragm back cavity 1503, resulting in a sound.

When the sound generated in the diaphragm front cavity 1502 is taken in by the one end 121 of the sound guiding unit 120, the sound propagates through the tube and is emitted from the other end 122 of the sound guiding unit 120 toward the interior of the ear canal. Thereafter, the sound reaches the eardrum.

On the other hand, the sound generated in the diaphragm back cavity 1503 is emitted to the outside from the exhaust holes 111 drilled in the back side of the housing of the sound generation unit 110 so as not to hinder the vibration of the diaphragm 1501.

As for the exhaust holes 111, in consideration of sound leakage to the outside, the inner diameter of the exhaust holes 111 is preferably 1.0 mm or less (e.g., 0.6 mm) if the sounding element in the sound generation unit 110 is a dynamic speaker with a diameter of 16 mm. In addition, in the example shown in FIG. 3, two exhaust holes 111 are drilled, but three or more exhaust holes 111 may be provided.

Figure 16:
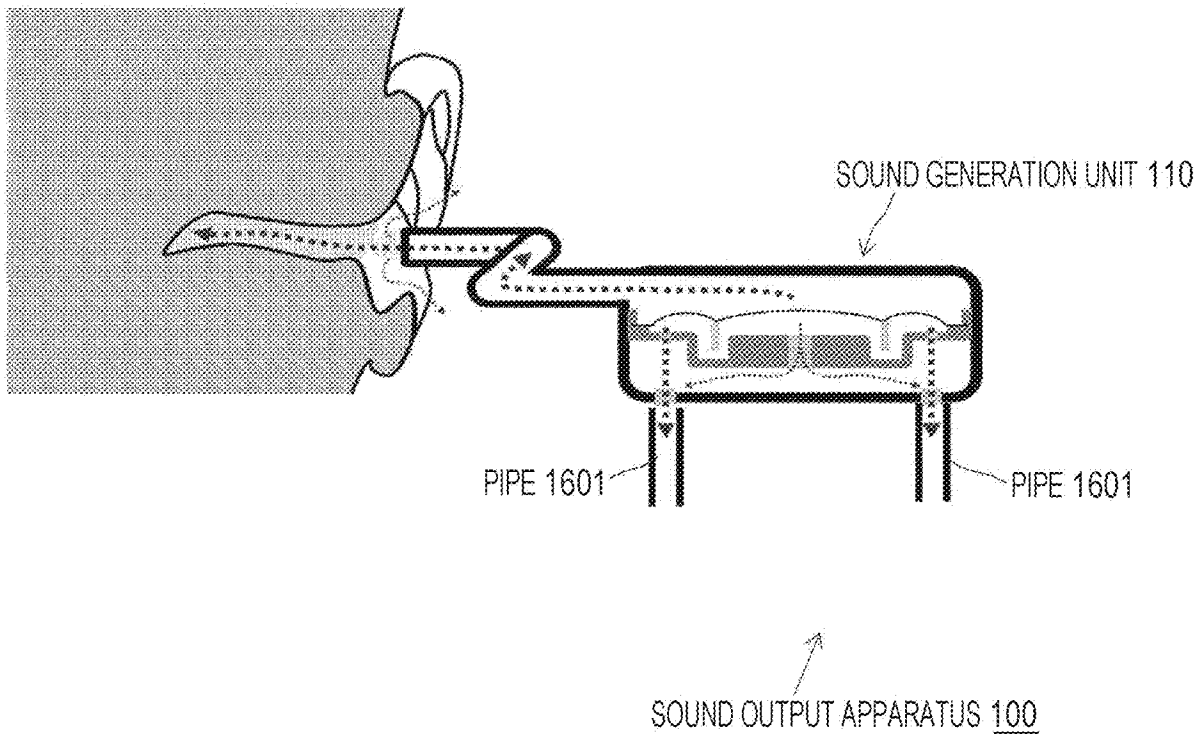
FIG. 16 is a view showing the configuration of the sound generation unit 110 in which pipes 1601 are attached to exhaust holes 111.

Moreover, as shown in FIG. 16, pipes 1601 may be attached to the respective exhaust holes 111 to particularly attenuate the high frequency components among the sounds leaking from the exhaust holes 111 in order to process the sound leakage from the exhaust holes 111. Since the high frequency components have a high frequency and strong rectilinearity, the high frequency components can be sufficiently removed via the elongated pipes 1601. Alternatively, instead of the pipes 1601, a sound absorbing material (acoustic resistance) such as a mesh, which removes the high frequency components, may be pitched inside the housing.

Note that, besides the above dynamic type, the sounding element of the sound generation unit 110 may be any one of a balanced armature type, a capacitor type, a piezoelectric type and an electrostatic type, or a combination of two or more.

B. Advantages of Ear-Hole Open Type Earphones

The feature of the sound output apparatus 100 according to the present embodiment is that the sound output apparatus 100 is an ear-hole open type, and the advantages thereof will be summarized.

(1) The listener can naturally hear the ambient sound even while wearing the sound output apparatus 100. Therefore, it is possible to normally utilize human functions dependent on aural characteristics, such as spatial grasping, danger sensing, and grasping of conversation and subtle nuances during conversation.

(2) Since the sound output apparatus 100 does not close the ear holes when being worn, the wearer has an appearance that other people may speak to the wearer. Moreover, since the listener wearing the sound output apparatus 100 always hears the ambient sound, the listener presents at least passive attitude, as human nature, such as "changing the direction of the body in the sound direction," or "taking a look in the sound direction" from the acoustic information such as footsteps when a person approaches. Since such behavior gives the impression to other people that "they may speak to the listener," communication between people is not hindered.

(3) The sound output apparatus 100 is not affected by the self-generated noise sound. Since the other end 122 of the sound guiding unit 120, which is the sound output hole, is apart from the inner wall of the ear canal at the time of being worn on the ear hole, the sound output apparatus 100 is not affected by the listener's own voice, the beating sound, the mastication sound, the sound when swallowing saliva, the blood flow sound, the breathing sound, the vibration sound conveyed through the body during walking, or the rustle of clothes with a cord or the like. Moreover, no frictional sound occurs between the earpiece and the inner wall of the ear canal. Furthermore, since the ear hole is released, there is no worry about dampness stuck in the ear canal.

(4) The sound output apparatus 100 has good wearability on the ears and can absorb positioning variations caused by individual differences in the size and shape of ears or the like. The sound output apparatus 100 is configured such that the holding unit 130 is engaged with the intertragic notch so as to support the sound output hole of the other end 122 of the sound guiding unit 120 to face the ear canal. Therefore, it is unnecessary to adjust the length as in the case of the ear-hanging type sound output apparatus in which a sound guiding body folds back at the helix 301. Moreover, the holding unit 130 engages with the intertragic notch, and thereby a good wearing state can be maintained. Furthermore, the tensile force by the wire 140 acts on the bent portion 123 of the sound guiding unit 120, and thereby a good wearing state can be maintained. In addition, even when the structure, in which the sound guiding unit 120 folds back at the earlobe 313 and extends from the back face of the pinna to the vicinity of the ear canal entrance, is used together with eyeglasses, an eyeglass type wearable device or an ear-hanging type device by the listener, the structure does not interfere with these other apparatuses.

(5) The sound guiding unit 120 propagates the sound generated by the sound generation unit 110 from behind the ear to the vicinity of the entrance of the ear canal with the shortest distance. Therefore, as compared with the ear-hanging type sound output apparatus, the sound loss can be suppressed to the minimum by the length of the sound guiding unit being shortened, the sound generation unit 110 is set to have a low output, and good sound quality can be obtained. That is to say, the dimensional tolerance of the sound generation unit 110 is high, and it is possible to design according to the required acoustic band and sound pressure.

C. Modification Examples of Sound Generation Unit

Figure 17:
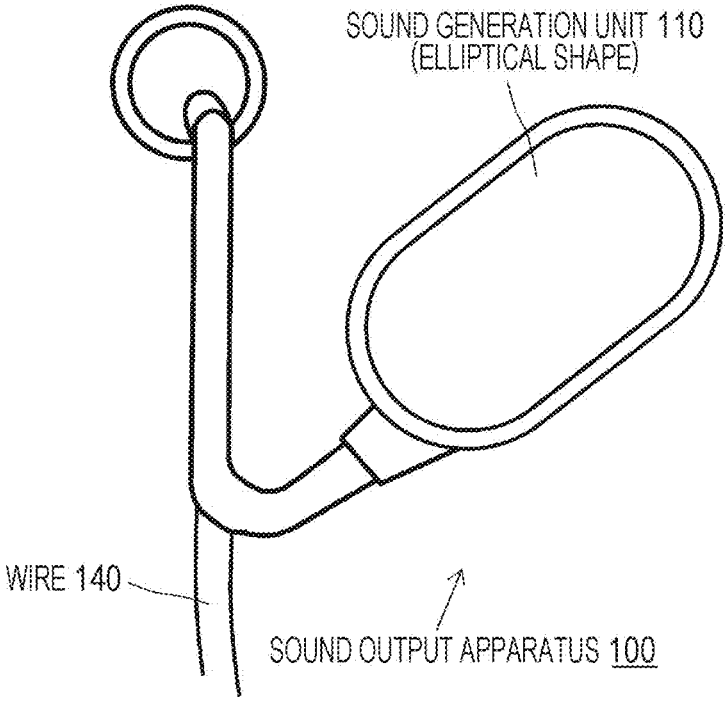
FIG. 17 is a view exemplifying an appearance of the sound output apparatus 100 including the sound generation unit 110 having an elliptical shape.
Figure 18:
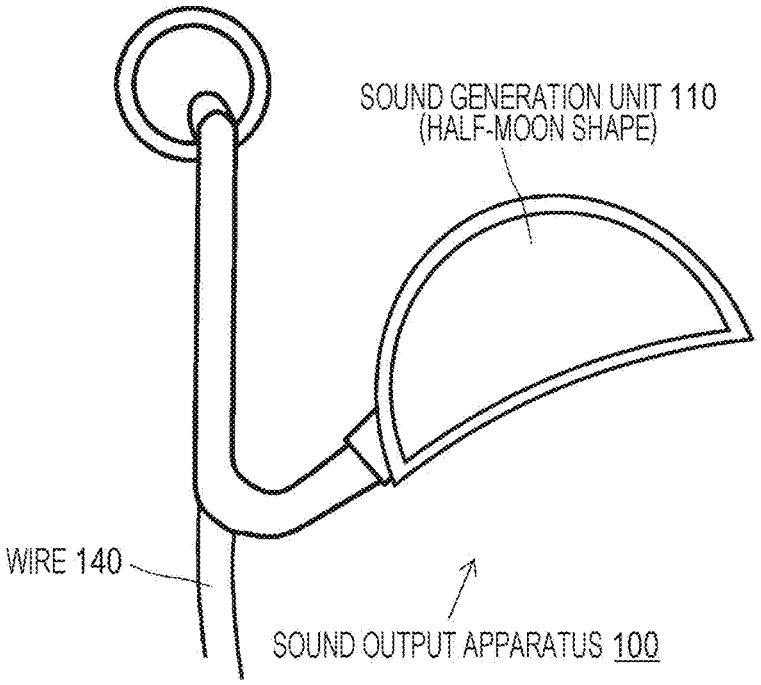
FIG. 18 is a view exemplifying an appearance of the sound output apparatus 100 including the sound generation unit 110 with a half-moon shape.

The shape of the sound generation unit 110 illustrated heretofore is discoid, but is not limited to this shape. For example, the sound generation unit 110 can be configured in any shape so as to match the shape of the sounding element accommodated therein or to conform to the rear side surface of the pinna. For example, the sound generation unit 110 may have an elliptical shape shown in FIG. 17, or the sound generation unit 110 may have a half-moon shape shown in FIG. 18.

Figure 19:
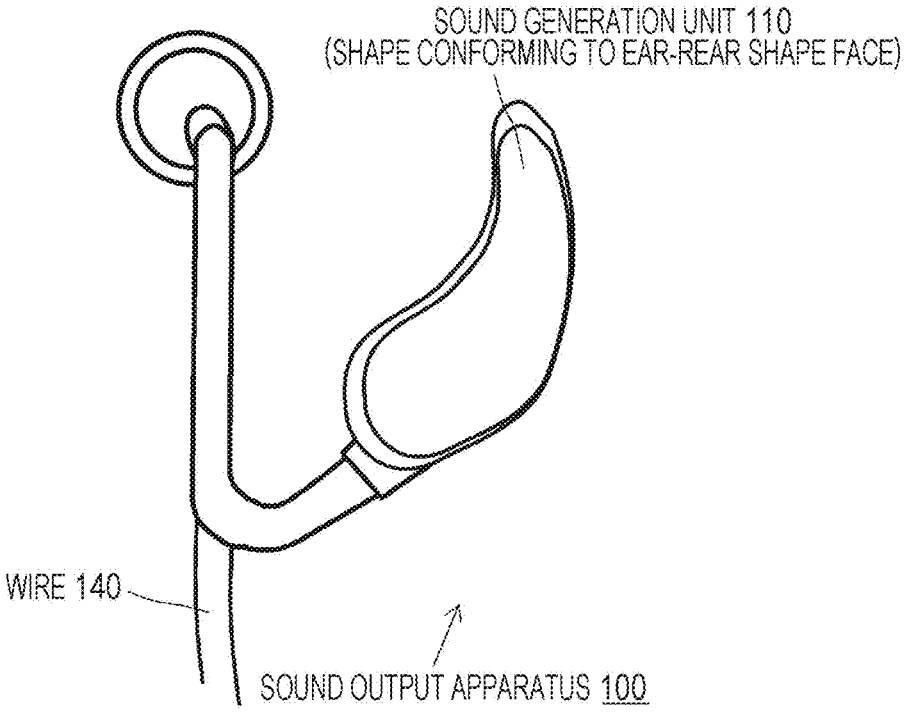
FIG. 19 is a view exemplifying an appearance of the sound output apparatus 100 including the sound generation unit 110 having a shape whose side edge conforms to a human ear-rear shape face.

Moreover, in consideration of the great individual differences in the shape of the rear of the human ear, the shape of the sound generation unit 110 may be formed in a shape which conforms to the ear-rear shape face of the individual. FIG. 19 exemplifies an appearance of the sound output apparatus 100 including the sound generation unit 110 having a shape whose side edge conforms to the human ear-rear shape face.

Figure 20:
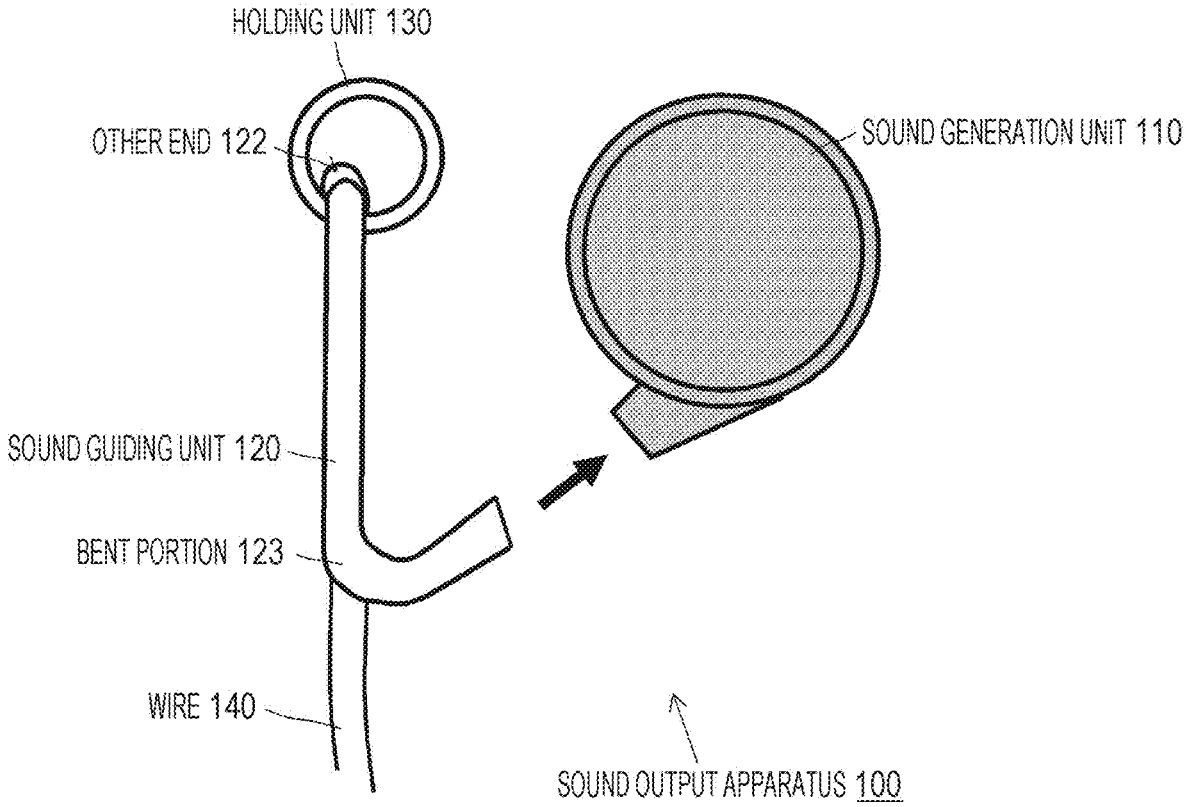
FIG. 20 is a view showing a configuration example of the sound output apparatus 100 from which the sound generation unit 110 can be detached.

Furthermore, as shown in FIG. 20, the sound output apparatus 100 may be configured so that the sound generation unit 110 can be detached. Advantages of making the sound generation unit 110 detachable include that the sound generation unit 110 can be replaced with the sound generation unit 110 having a housing conforming to the ear-rear shape of each person as appropriate, that the sound generation unit 110 with a favorable performance can be selected to be used, and the like. For example, it is possible to select and use a sound generation unit that focuses on high and low pitch sounds, a sound generation unit with high resolution, or the like.

D. Modification Examples of Holding Unit

Figure 21:
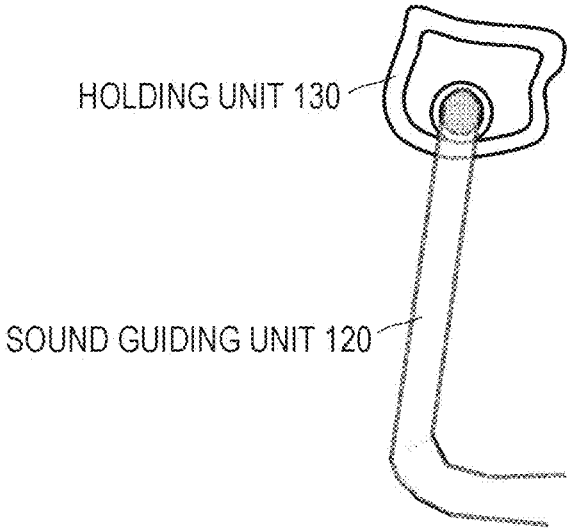
FIG. 21 is a view showing a state in which the holding unit 130 configured in a shape, which conforms to the shape face of the bottom face of the cavum concha in the intertragic notch space of a human ear, is viewed from the front.
Figure 22:
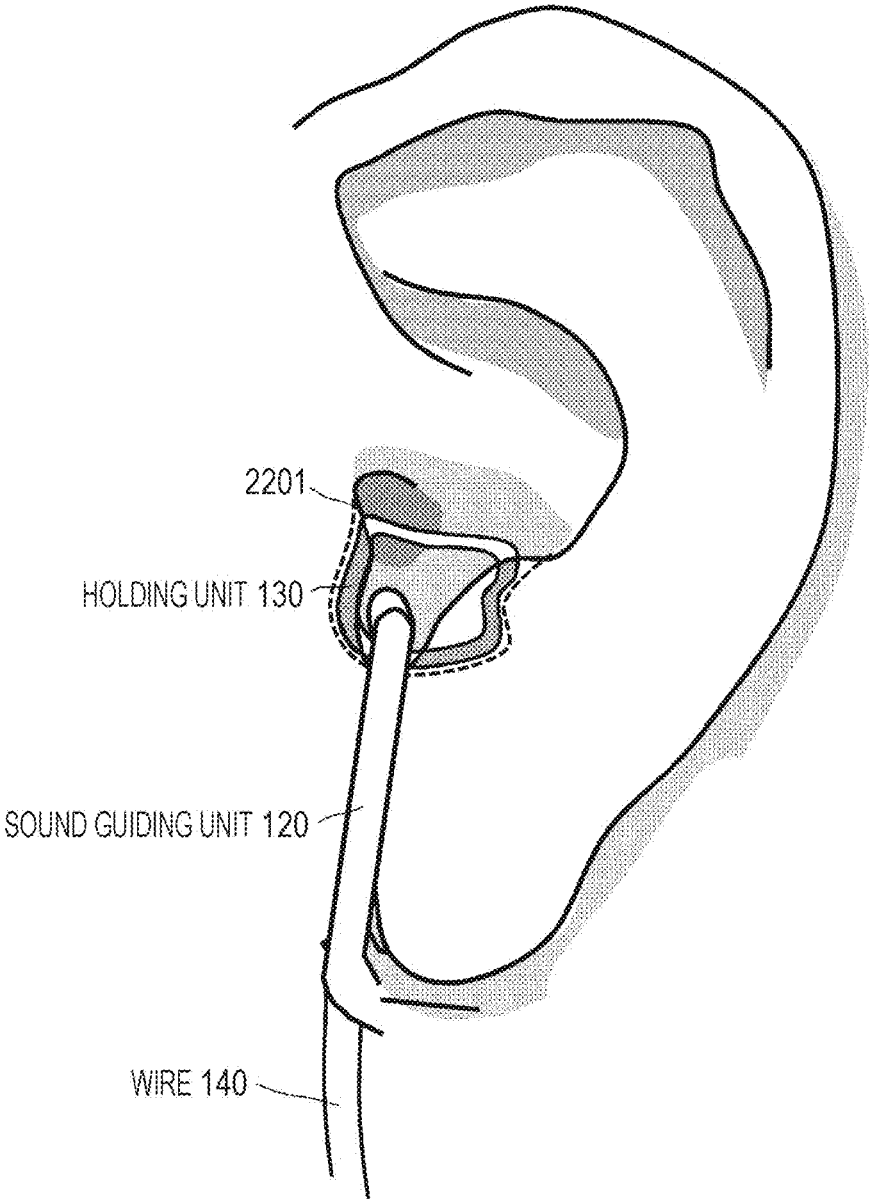
FIG. 22 is a view showing a state in which the holding unit 130 shown in FIG. 21 is worn on the left ear of a listener.

The holding unit 130 is also configured in a shape which conforms to the shape face of the bottom face of the cavum concha in the intertragic notch space of the ear of the individual so that the retention of the holding unit 130 to the intertragic notch can be good. FIG. 21 shows a state in which the holding unit 130 configured in a shape, which conforms to the shape face of the bottom face of the cavum concha in the intertragic notch space of the ear of the individual, is viewed from the front. Moreover, FIG. 22 shows a state in which the holding unit 130 shown in FIG. 21 is worn on the left ear of a listener. As can be seen from FIG. 22, since the holding unit 130 worn on the intertragic notch of the left ear conforms to a shape face 2201 in the intertragic notch space of the ear of the listener, the retention to the intertragic notch becomes better.

Figure 23:
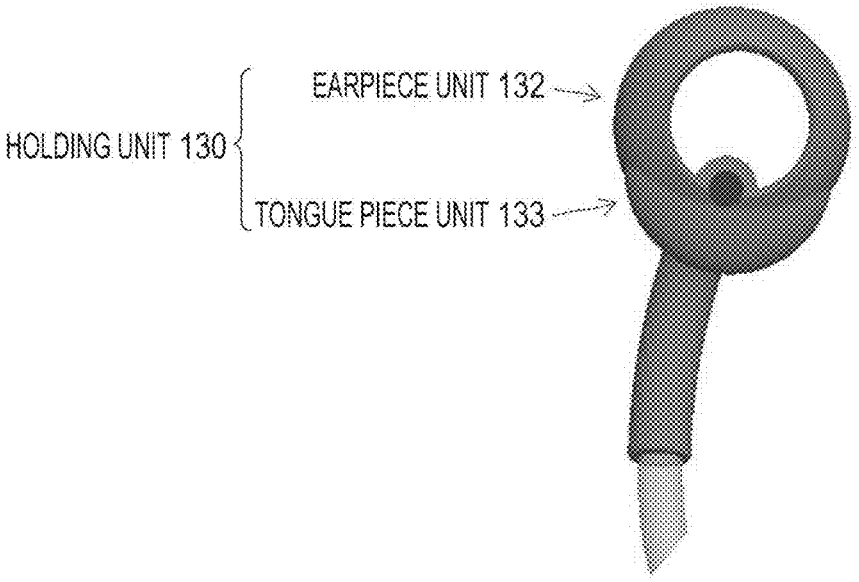
FIG. 23 is a view showing a configuration example of the holding unit 130 including an earpiece unit 132 and a tongue piece unit 133.

FIG. 23 shows another configuration example of the holding unit 130. The illustrated holding unit 130 includes an earpiece unit 132 with a hollow structure locked to the intertragic notch 312 and a tongue piece unit 133 protruding from the vicinity of the lower end of the earpiece unit 132. When the holding unit 130 is inserted into the cavum concha 310 and hooked on the intertragic notch 312, the tongue piece unit 133 abuts the bottom portion of the cavum concha 310. Both the earpiece unit 132 and the tongue piece unit 133 can be created by, for example, an elastomer. The earpiece unit 132 is made hard so as to prevent the falling off from the intertragic notch 312, while the tongue piece unit 133 is made soft, thereby improving the wearing sense. For example, the holding unit 130 can be created by molding the earpiece unit 132 and the tongue piece unit 133 with elastomers of two colors.

Figure 24:
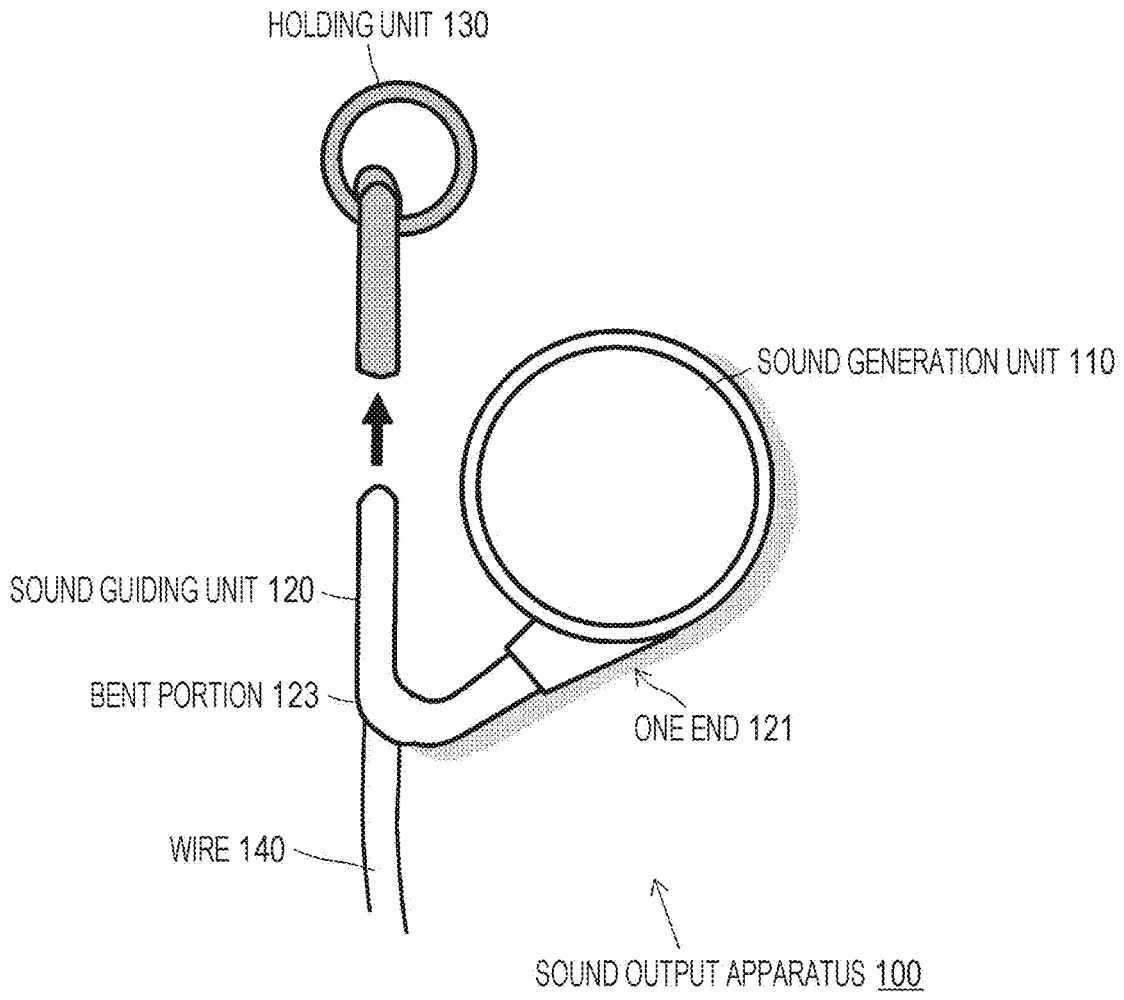
FIG. 24 is a view showing a configuration example of the sound output apparatus 100 from which the holding unit 130 can be detached.

Moreover, the sound output apparatus 100 may be configured so that the holding unit 130 can be detached. FIG. 24 shows a configuration example of the holding unit 130 detachable in the vicinity of the middle of the sound guiding unit 120. However, a site where the holding unit 130 is separated off from the sound output apparatus 100 can be anywhere. Advantages of making the holding unit 130 detachable include that the holding unit 130 can be replaced as appropriate with the holding unit 130 having a contour conforming to the shape of the bottom face of the cavum concha of each person, the holding unit 130 having the favorable hardness, or the like.

Note that, in the case where the holding unit 130 is configured to be detachably replaced as shown in FIG. 24, when the sound output apparatus 100 is worn on the pinna, the holding unit 130 rotates against the main body of the sound output apparatus 100 (or the sound guiding unit 120), causing a problem that it is difficult to handle. Thereupon, it is preferable that there be a mechanism for fixing (or preventing rotation) the rotational position of the holding unit 130 against the sound guiding unit 120.

E. Modification Examples of Wire

Figure 25:
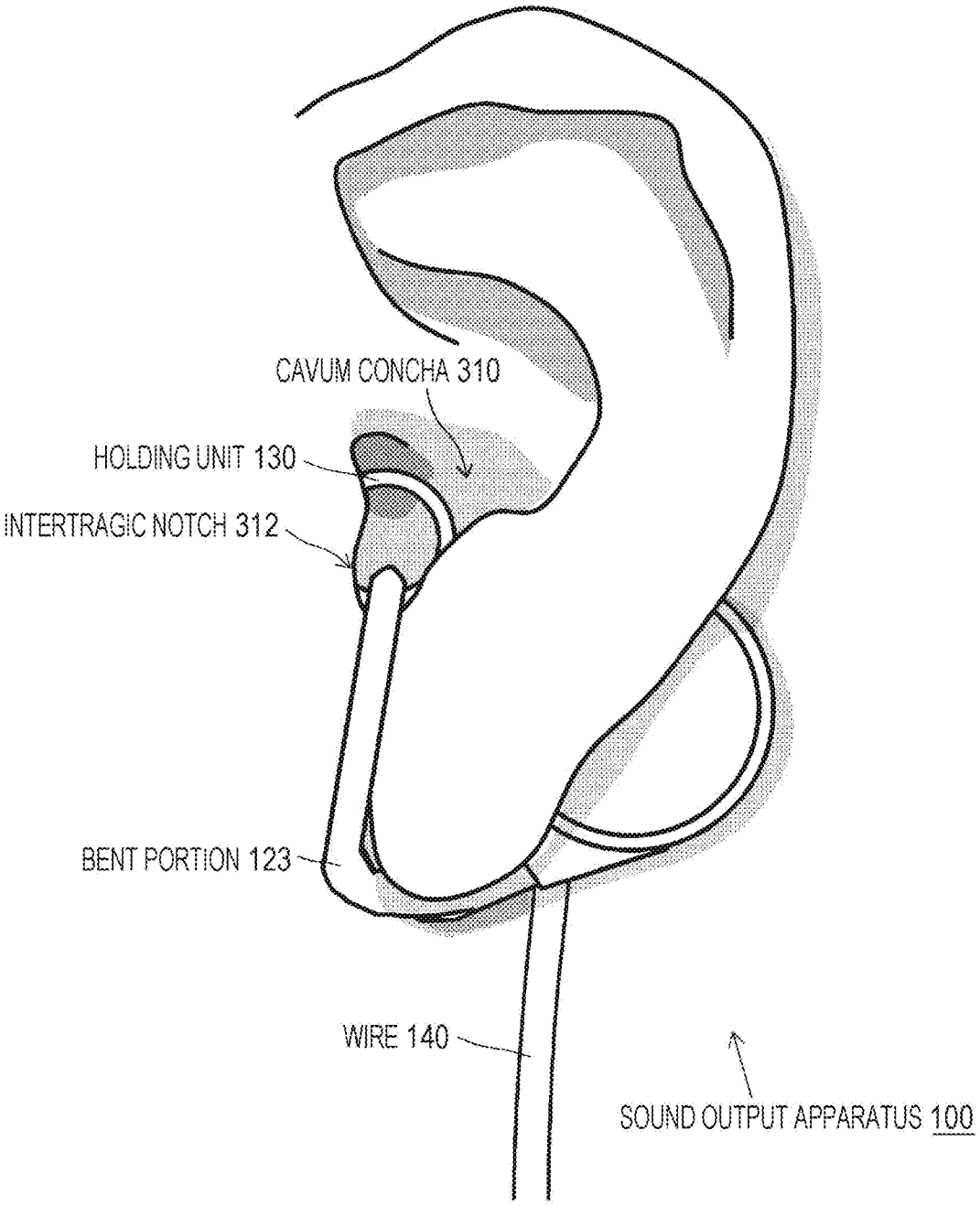
FIG. 25 is a view showing the sound output apparatus 100 configured to connect the wire 140 downward to the sound generation unit 110.

In the above, the configuration example of the sound output apparatus 100, in which the wire 140 is connected downward in the vicinity of the bent portion 123 of the sound guiding unit 120, has been described. On the other hand, as shown in FIG. 25, the sound output apparatus 100 can also be configured so that the wire 140 is connected downward to the bottom portion of the sound generation unit 110.

In the case of connecting the wire 140 to the sound generation unit 110, it is completely unnecessary to make the sound guiding unit 120 common to the conduit, and the sound guiding unit 120 can be easily molded. Moreover, since the electric wire is not inserted through the sound guiding unit 120, obstacles are eliminated for propagating the aerial vibration.

Figure 26:
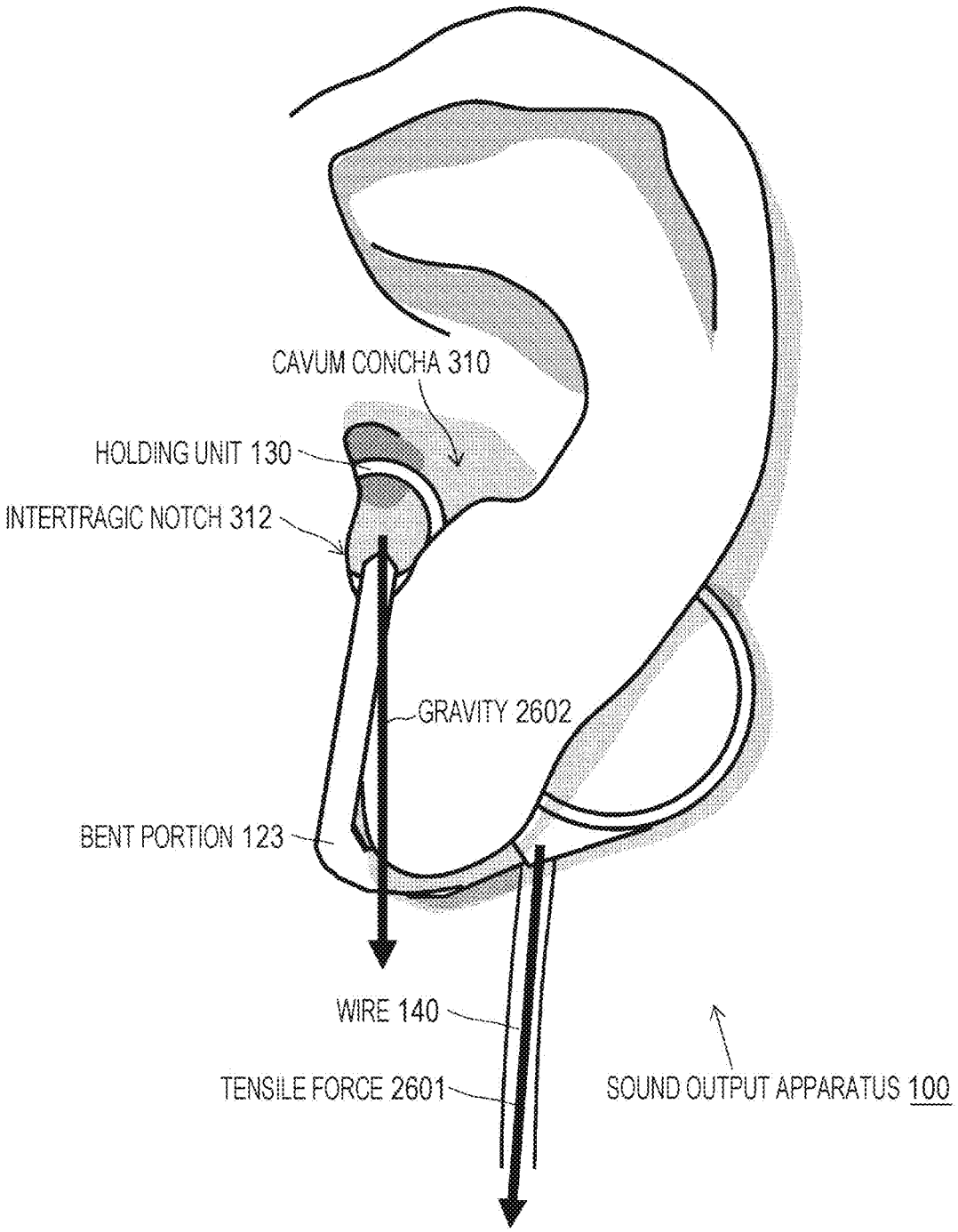
FIG. 26 is a view showing a tensile force acting on the wire 140.

Furthermore, also in the case where the wire 140 is connected downward to the bottom portion of the sound generation unit 110, there is also an advantage that the wearing stability of the sound output apparatus 100 is improved. As indicated by the reference numeral 2601 in FIG. 26, a tensile force of the downward wire 140 is applied to the sound generation unit 110. On the other hand, gravity is applied to the holding unit 130 locked to the intertragic notch 312 as indicated by the reference numeral 2602. As shown in the drawing, as a result of the tensile force 2601 acting in a direction approximate to the gravity 2602, the lower end of the holding unit 130 is pressed against the bottom portion of the cavum concha 310, and the wearing stability of the holding unit 130 on the intertragic notch 312 increases. Even if the normally assumed tensile force 2601 is applied to the wire 140, the holding unit 130 will not fall off from the intertragic notch 312.

Moreover, also in the example in which the wire 140 is attached to the vicinity of the bent portion 123 of the sound guiding unit 120 or to the sound generation unit 110, the wire 140 may be configured to be detachable from the main body of the sound output apparatus 100. For the connection between the sound output apparatus 100 and the wire 140, for example, a micro-miniature coaxial (MMCX) type connector, and a plug and a jack of 3.5 mm or 2.5 mm can be utilized.

Advantages of configuring the wire 140 to be detachable from the main body of the sound output apparatus 100 include that the wire 140 can be shared with other products and other users, that detaching the wire 140 is convenient to store and carry the sound output apparatus 100, and the like.

<Reference>

The structure of the pinna will be described with reference to FIG. 27. Broadly speaking, the structure of the pinna 300 includes the helix 301, the antihelix 302, the ear concha 303 and a tragus 304 in order from the outside. In addition, on the outer side of the tragus 304, there is an antitragus 305 which a projection to be paired. A slit between the tragus 304 and the antitragus 305 is the intertragic notch 312. Moreover, the lower end of the pinna 300 is the earlobe 313.

The helix 301 is a site that forms the contour of the ear at the outermost periphery of the ear. After having curved inward in the vicinity of the center of the pinna 300 (in the vicinity of the upper part of the ear canal entrance 311), the helix 301 substantially horizontally passes the vicinity of the middle of the pinna 300 and forms a projection which divides the ear concha 303 vertically. A crus of helix 306 is the vicinity where the helix 301 curves toward the inside of the pinna 300, and a root of helix 307 is a portion where the crus of helix 306 further enters the ear concha 303.

The antihelix 302 is a ridge line extending upward from the antitragus 305 and also corresponds to the rim of the ear concha 303. The ridge line forming the antihelix 302 is bifurcated, and the upper branch is called a superior crus of antihelix 302*a*, which corresponds to the upper side of a triangular fossa 308. In addition, the lower branch is called an inferior crus of antihelix 302*b*, which corresponds to the lower side of the triangular fossa 308.

The ear concha 303 is the most recessed portion at the center of the ear, divided into a cymba concha 309 which is an elongated recess in the upper half and the cavum concha 310 in the lower half with the root of helix 307 as the border. In addition, the ear canal entrance 311 is in the vicinity of the tragus 304 of the cavum concha 310.

The triangular fossa 308 is a triangular recess with three sides of the superior crus of antihelix 302*a*, the inferior crus of antihelix 302*b* and the helix 301. In addition, the scapha 314 is a recess between the antihelix 302 and the helix 301 at the outer upper portion in terms of the entire pinna 300.

INDUSTRIAL APPLICABILITY

The technology disclosed herein has been described above in detail with reference to specific embodiments. However, it is obvious that those skilled in the art can make modifications and substitutions of the embodiments in a scope without departing from the gist of the technology disclosed herein.

Although the sound output apparatus to which the technology disclosed herein is applied is used by being worn on the ears of the listener, it differs greatly from the conventional earphones in terms of "ear-hole open type." Therefore, the features of the sound output apparatus to which the technology disclosed herein is applied are that the sound output apparatus can realize listening characteristics of the ambient sound even in a wearing state, which are equivalent to those in a non-wearing state, and output acoustic information at the same time and that the ear holes of the listener appear not to be closed to the people around even in the wearing state. By taking advantage of such features, the sound output apparatus to which the technology disclosed herein is applied can be applied to the fields of various sports (during play, remote coaching and the like) performed outdoors, such as walking, jogging, cycling, climbing, skiing and snowboarding, and indoors, the fields of communication or presentation which requires listening to the ambient sound and presenting the audio information at the same time (e.g., supplementary information at the time of watching a play, audio information presentation in museums, bird watching (cry listening) and the like), driving or navigation, security guards, newscasters and the like.

In short, the technology disclosed herein has been described in the form of exemplification, and the contents of the description herein should not be interpreted strictly. To judge the gist of the technology disclosed herein, the scope of claims should be taken into consideration.

Note that the technology disclosed herein can adopt the following configurations.

(1) A sound output apparatus including:

a sound generation unit disposed at a back face of an ear of a listener;

a sound guiding unit whose one end is connected to the sound generation unit and the other end is disposed in an pinna of the listener, and which takes in sound generated by the sound generation unit from the one end, propagates the sound to the other end, and has an unfilled structure; and a wire connected downward.

(2) The sound output apparatus according to (1), further including a holding unit which holds the other end of the sound guiding unit in a vicinity of an entrance of an ear canal of the listener.

(3) The sound output apparatus according to (2), in which the holding unit is inserted into a cymba concha of the listener and locked to an intertragic notch.

(4) The sound output apparatus according to (3), in which the sound guiding unit is inserted through the intertragic notch in a vicinity of the other end.

(5) The sound output apparatus according to (2), in which the holding unit supports the sound guiding unit in a vicinity of the other end so that a sound output hole of the other end is positioned to face the ear canal.

(6) The sound output apparatus according to (2), in which the other end of the sound guiding unit is substantially flush with a bottom face of the holding unit.

(7) The sound output apparatus according to (2), in which the holding unit has a hollow structure and is coupled to the other end of the sound guiding unit at an inner periphery.

(8) The sound output apparatus according to (1), in which the wire is connected downward in a vicinity of a lower end of the sound guiding unit.

(9) The sound output apparatus according to (1), in which the sound guiding unit has a bent portion which folds back at a lower end of the pinna, and the wire is connected downward in a vicinity of the bent portion.

(10) The sound output apparatus according to (9), in which a signal line included in the wire is inserted through the sound guiding unit.

(11) The sound output apparatus according to (1), in which the wire is connected downward to a housing of the sound generation unit.

(12) The sound output apparatus according to (1), in which the sound generation unit includes a sounding element which generates a sound pressure change, and a housing which accommodates the sounding element.

(13) The sound output apparatus according to (12), in which the housing includes at least one exhaust hole and a sound leakage prevention unit which prevents sound leakage from the exhaust hole.

(14) The sound output apparatus according to (1), in which the sound generation unit is detachable.

(15) The sound output apparatus according to (2), in which the holding unit includes an earpiece unit with a hollow structure, and a tongue piece unit protruding from a lower end of the earpiece unit.

(16) The sound output apparatus according to (2), in which the holding unit is detachable.

(17) The sound output apparatus according to (1), in which the wire is detachable.

REFERENCE SIGNS LIST

100 Sound output apparatus
110 Sound generation unit
111 Exhaust hole
120 Sound guiding unit
121 One end (sound input hole)
122 Other end (sound output hole)
123 Bent portion
130 Holding unit
131 Opening portion
132 Earpiece unit
133 Tongue piece unit
140 Wire
1501 Diaphragm
1504 Magnet
1505 Voice coil
1601 Pipe

The invention claimed is:

1. A sound output apparatus, comprising:

a sound generation unit at a rear side of an ear of a listener;

a sound guiding unit that comprises a bent portion that folds back at a lower end of a pinna of the listener, wherein a first end of the sound guiding unit is connected to the sound generation unit and a second end of the sound guiding unit is in the pinna of the listener, the sound guiding unit is configured to receive sound generated by the sound generation unit from the first end, the sound guiding unit is configured to propagate the sound to the second end, and the sound guiding unit has an unfilled structure; and a wire connected downward in a vicinity of the bent portion.

2. The sound output apparatus according to claim 1, further comprising a holding unit configured to hold the second end of the sound guiding unit at an entrance of an ear canal of the listener.

3. The sound output apparatus according to claim 2, wherein the holding unit is inserted into a cymba concha of the listener and locked to an intertragic notch of the listener.

4. The sound output apparatus according to claim 3, wherein the sound guiding unit is inserted through the intertragic notch of the listener.

5. The sound output apparatus according to claim 2, wherein the holding unit is configured to support the sound guiding unit at the second end so that a sound output hole of the second end is positioned toward the ear canal.

6. The sound output apparatus according to claim 2, wherein the second end of the sound guiding unit is substantially flush with a bottom side of the holding unit.

7. The sound output apparatus according to claim 2, wherein the holding unit comprises a hollow structure and is coupled to the second end of the sound guiding unit at an inner periphery of the sound guiding unit.

8. The sound output apparatus according to claim 2, wherein the holding unit further comprises:

an earpiece unit with a hollow structure; and a tongue piece unit that protrudes from a lower end of the earpiece unit.

9. The sound output apparatus according to claim 2, wherein the holding unit is detachable.

10. The sound output apparatus according to claim 1, wherein the wire is connected at a lower end of the sound guiding unit.

11. The sound output apparatus according to claim 1, wherein a signal line included in the wire is inserted through the sound guiding unit.

12. The sound output apparatus according to claim 1, wherein the wire is further connected to a housing of the sound generation unit.

13. The sound output apparatus according to claim 1, wherein the sound generation unit further comprises:

a sounding element configured to generate a sound pressure change; and a housing configured to accommodate the sounding element.

14. The sound output apparatus according to claim 13, wherein the housing comprises:

at least one exhaust hole; and a sound leakage prevention unit configured to prevent sound leakage from the exhaust hole.

15. The sound output apparatus according to claim 1, wherein the sound generation unit is detachable.

16. The sound output apparatus according to claim 1, wherein the wire is detachable.

* * * * *